US008876268B2

(12) United States Patent
Mizuno

(10) Patent No.: US 8,876,268 B2
(45) Date of Patent: Nov. 4, 2014

(54) INK CARTRIDGE

(75) Inventor: Naoki Mizuno, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/428,755

(22) Filed: Mar. 23, 2012

(65) Prior Publication Data

US 2012/0249693 A1 Oct. 4, 2012

(30) Foreign Application Priority Data

Mar. 30, 2011 (JP) ..... 2011-076694

(51) Int. Cl.
*B41J 2/175* (2006.01)

(52) U.S. Cl.
CPC ..... *B41J 2/17553* (2013.01); *B41J 2/17513* (2013.01); *B41J 2/1752* (2013.01); *B41J 2/17523* (2013.01)
USPC ..... 347/85; 347/86; 347/84

(58) Field of Classification Search
CPC ..... B41J 2/175
USPC ..... 347/85
See application file for complete search history.

(56) References Cited

U.S. PATENT DOCUMENTS 4,719,475 A 1/1988 Kiyohara et al.
4,760,409 A 7/1988 Kiyohara et al.
5,359,353 A 10/1994 Hunt et al.
5,552,816 A 9/1996 Oda et al.
5,611,461 A 3/1997 Kubota et al.
5,844,578 A 12/1998 Mochizuki et al.
6,000,791 A * 12/1999 Scheffelin et al. ..... 347/87
6,068,371 A * 5/2000 Wallace et al. ..... 347/86
6,206,515 B1 * 3/2001 Swanson et al. ..... 347/87
6,270,210 B1 * 8/2001 Yamaguchi et al. ..... 347/86
6,412,894 B1 7/2002 Askren et al.
6,505,924 B2 1/2003 Shimizu
6,609,789 B1 8/2003 Hunt
6,637,872 B2 10/2003 Ara et al.
6,719,415 B1 4/2004 Hattori et al.
6,773,099 B2 8/2004 Inoue et al.

(Continued)

FOREIGN PATENT DOCUMENTS

JP 2006240131 A 9/2006
JP 2011000751 A 1/2011

OTHER PUBLICATIONS

Office Action issued Nov. 5, 2013 in U.S. Appl. No. 13/428,806.

*Primary Examiner* — Matthew Luu
*Assistant Examiner* — Lily Kemathe
(74) *Attorney, Agent, or Firm* — Fox Rothschild LLP

(57) ABSTRACT

An ink cartridge includes a bag-shaped ink bag storing ink inside and having a spout through which the ink can be drawn out, a substantially box-shaped case housing the ink bag and having at least a first wall portion and a second wall portion arranged to oppose each other, a first leg portion protruding from an outer surface of the first wall portion and being disposed on a first end of the first wall portion positioned in a longitudinal direction and separated from both ends positioned in a first direction of the first wall portion, and a second leg portion protruding from the outer surface of the first wall portion and being disposed in a position separated from the first leg portion on the first end of the first wall portion and separated from the both ends in the first direction.

11 Claims, 34 Drawing Sheets

(56) References Cited

U.S. PATENT DOCUMENTS

| | | | | |
|---|---|---|---|---|
| 6,886,928 | B2 | 5/2005 | Sasaki et al. | |
| 7,077,514 | B2 | 7/2006 | Inoue et al. | |
| 7,104,640 | B2 | 9/2006 | Ogura et al. | |
| 7,216,963 | B2 * | 5/2007 | Takagi et al. | 347/86 |
| 7,513,613 | B2 | 4/2009 | Ishizawa et al. | |
| 7,543,925 | B2 | 6/2009 | Ishizawa et al. | |
| 7,581,808 | B2 | 9/2009 | Ishizawa et al. | |
| 7,651,208 | B2 * | 1/2010 | Matsumoto | 347/86 |
| 7,699,453 | B2 | 4/2010 | Ishizawa et al. | |
| 7,722,174 | B2 | 5/2010 | Kimura et al. | |
| 7,744,203 | B2 | 6/2010 | Takagi | |
| 7,905,587 | B2 | 3/2011 | Matsumoto | |
| 7,997,703 | B2 * | 8/2011 | Naka et al. | 347/86 |
| 7,997,708 | B2 | 8/2011 | Chung et al. | |
| D647,558 | S | 10/2011 | Eto | |
| 8,091,995 | B2 | 1/2012 | Shimizu et al. | |
| 8,123,341 | B2 | 2/2012 | Kimura | |
| 8,128,211 | B2 | 3/2012 | Chung et al. | |
| 8,272,704 | B2 | 9/2012 | Gilson et al. | |
| 8,646,886 | B2 * | 2/2014 | Hayakawa et al. | 347/85 |
| 2001/0040613 | A1 * | 11/2001 | Nakazawa et al. | 347/86 |
| 2002/0113852 | A1 | 8/2002 | Kimura et al. | |
| 2002/0122084 | A1 * | 9/2002 | Shihoh et al. | 347/7 |
| 2002/0130933 | A1 | 9/2002 | Chan et al. | |
| 2003/0067519 | A1 * | 4/2003 | Hayashi et al. | 347/85 |
| 2003/0095168 | A1 * | 5/2003 | Blease et al. | 347/92 |
| 2004/0056934 | A1 * | 3/2004 | Seino et al. | 347/85 |
| 2004/0145625 | A1 | 7/2004 | Matsumoto et al. | |
| 2005/0041078 | A1 * | 2/2005 | Kimura et al. | 347/86 |
| 2005/0057625 | A1 | 3/2005 | Ishizawa et al. | |
| 2005/0157109 | A1 | 7/2005 | Muranaka et al. | |
| 2006/0007278 | A1 | 1/2006 | Holland et al. | |
| 2006/0164472 | A1 * | 7/2006 | Perez | 347/85 |
| 2006/0197813 | A1 | 9/2006 | Ikezaki | |
| 2006/0203053 | A1 | 9/2006 | Katsumura | |
| 2006/0215002 | A1 | 9/2006 | Ishizawa et al. | |
| 2006/0221153 | A1 | 10/2006 | Kojima et al. | |
| 2006/0227190 | A1 | 10/2006 | Ishizawa et al. | |
| 2006/0256174 | A1 | 11/2006 | Kawamura et al. | |
| 2007/0019048 | A1 | 1/2007 | Ito | |
| 2007/0040874 | A1 * | 2/2007 | Matsumoto | 347/85 |
| 2007/0186984 | A1 | 8/2007 | Kimura | |
| 2007/0222833 | A1 | 9/2007 | Ishizawa et al. | |
| 2007/0229629 | A1 | 10/2007 | Miyazawa et al. | |
| 2007/0295206 | A1 | 12/2007 | Ishizawa et al. | |
| 2008/0012915 | A1 | 1/2008 | Ishizawa et al. | |
| 2008/0151018 | A1 | 6/2008 | Aoki et al. | |
| 2008/0204527 | A1 | 8/2008 | Yuen | |
| 2008/0284832 | A1 | 11/2008 | Chung et al. | |
| 2008/0291252 | A1 | 11/2008 | Sakai et al. | |
| 2009/0064501 | A1 | 3/2009 | Kimura et al. | |
| 2009/0073245 | A1 | 3/2009 | Chung et al. | |
| 2009/0102902 | A1 | 4/2009 | Nose et al. | |
| 2009/0237474 | A1 | 9/2009 | Ishizawa et al. | |
| 2009/0237475 | A1 | 9/2009 | Ishizawa | |
| 2009/0244223 | A1 | 10/2009 | Mizutani et al. | |
| 2009/0289971 | A1 | 11/2009 | Gilson et al. | |
| 2009/0290001 | A1 * | 11/2009 | Domae | 347/85 |
| 2009/0303299 | A1 * | 12/2009 | Gilson et al. | 347/86 |
| 2009/0322832 | A1 | 12/2009 | Wanibe et al. | |
| 2009/0322839 | A1 | 12/2009 | Ishizawa et al. | |
| 2010/0013896 | A1 | 1/2010 | Ishizawa et al. | |
| 2010/0045755 | A1 * | 2/2010 | Kobayashi | 347/86 |
| 2010/0225716 | A1 | 9/2010 | Hayakawa et al. | |
| 2010/0289856 | A1 * | 11/2010 | Yamamoto et al. | 347/85 |
| 2012/0162327 | A1 | 6/2012 | Mizuno et al. | |

* cited by examiner

INK CARTRIDGE

CROSS-REFERENCE TO RELATED APPLICATIONS

This application claims priority to Japanese Patent Application No. 2011-076694, filed on Mar. 30, 2011, the disclosure of which is herein incorporated by reference in its entirety.

BACKGROUND

The present invention relates to an ink cartridge that stores ink internally and discharges the ink to the outside.

As a general ink cartridge, an ink cartridge is known that includes an ink bag that stores ink inside, a spout through which the stored ink can be drawn out from the ink bag and a rectangular parallelepiped case that houses the ink bag.

SUMMARY

The case of the ink cartridge is, for example, formed in a thin rectangular box shape, and outer surfaces of each of side walls are flat surfaces. Thus, when a user drops the ink cartridge on the ground or when the ink cartridge is placed on a flat surface, no gap is formed between the ground or the placement surface and the outer surface of the case. Thus, it may be difficult for the user to pick up the ink cartridge.

Various exemplary embodiments of the general principles herein provide an ink cartridge that can easily be picked up by a user in a state in which the ink cartridge is placed on a flat surface.

Exemplary embodiments herein provide an ink cartridge that includes a bag-shaped ink bag, a substantially box-shaped case, a first leg portion, and a second leg portion. The ink bag stores ink inside and includes a spout through which the ink can be drawn out. The case houses the ink bag and includes at least a first wall portion and a second wall portion that are a pair of plate-shaped wall portions arranged to oppose each other. The first leg portion protrudes from an outer surface of the first wall portion. The first leg portion is disposed on a first end that is one of ends positioned in a longitudinal direction of the first wall portion, and is separated from both ends positioned in a first direction of the first wall portion. The first direction is orthogonal to the longitudinal direction of the first wall portion. The second leg portion protrudes from the outer surface of the first wall portion. The second leg portion is disposed on the first end of the first wall portion, and is separated from the first leg portion, and also separated from the both ends positioned in the first direction.

BRIEF DESCRIPTION OF THE DRAWINGS

Exemplary embodiments of the present invention will be described below in detail with reference to the accompanying drawings in which.

DETAILED DESCRIPTION

Hereinafter, an embodiment of the present invention will be explained with reference to the appended drawings. In the present embodiment, an inkjet printer (hereinafter simply referred to as a printer) 100 that can print on a fabric, such as a T-shirt etc., and an ink cartridge (hereinafter simply referred to as a cartridge) 1 that can be used in the printer 100 will be explained.

First, a schematic configuration of the printer 100 will be explained with reference to FIG. 1. The printer 100 may be a known printer that can perform printing on a fabric, which is a print medium, by a print head 114 using ink supplied from the cartridge 1. Therefore, the configuration of the printer 100 will be briefly explained. An up-down direction, a left-right direction and a lower left direction in FIG. 1 respectively correspond to an up-down direction, a left-right direction and a front side of the printer 100, and also an up-down direction, a left-right direction and a front side of the cartridge 1.

Figure 1:
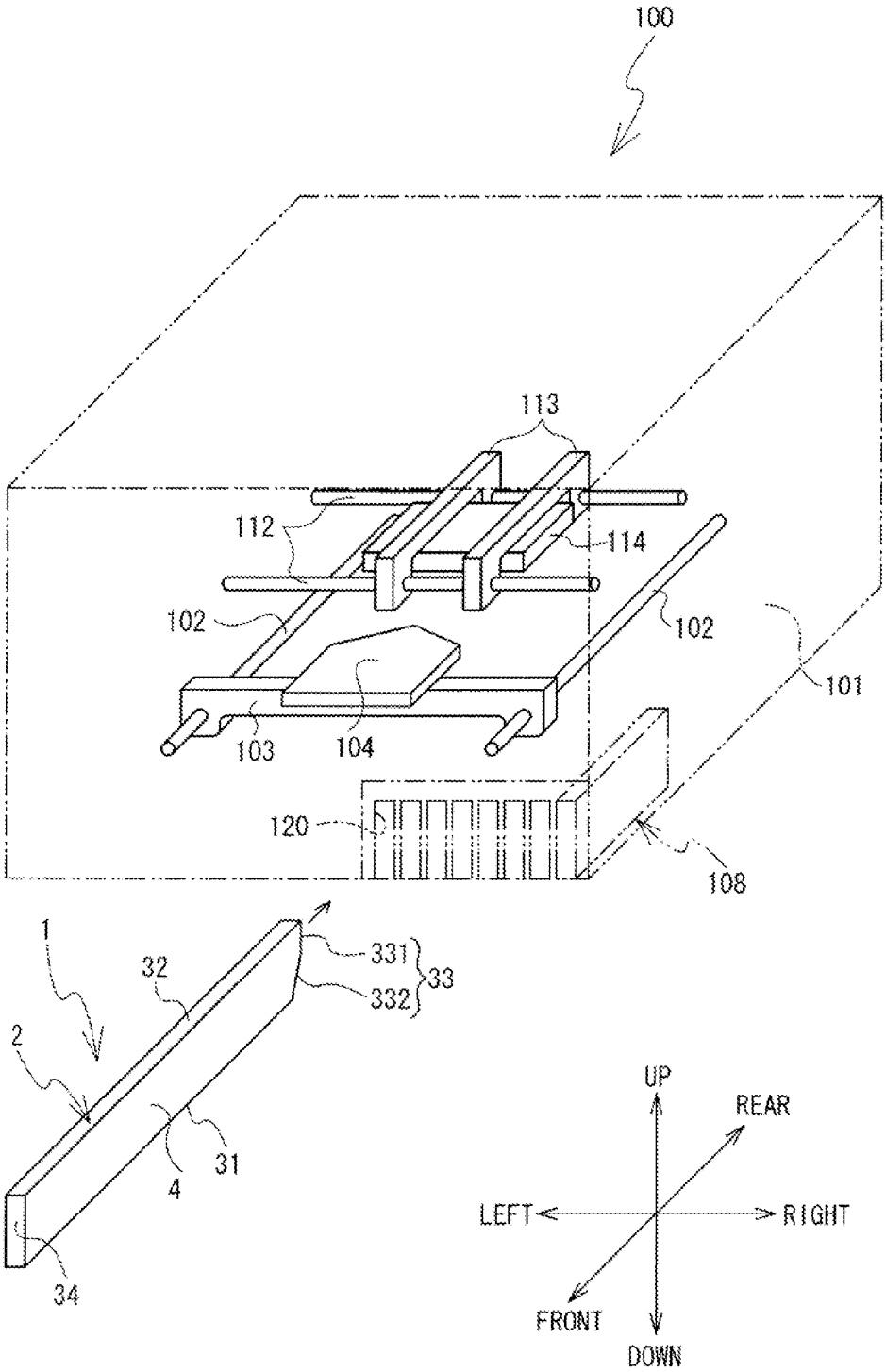
FIG. 1 is a schematic view showing an outline configuration of an inkjet printer 100.

As shown in FIG. 1, the printer 100 includes a housing 101 that has a rectangular box shape. A pair of guide rails 102 that extend in a front-rear direction are provided in a substantially central lower portion in the left-right direction inside the housing 101. A platen support 103 is supported by the guide rails 102 such that it can move in the front-rear direction along the guide rails 102. A replaceable platen 104 is fixed to a substantially center position in the left-right direction of an upper surface of the platen support 103. The platen 104 is a plate having a generally pentagonal shape in a plan view. A fabric (such as a T-shirt) that is a printing target may be placed on the upper surface of the platen 104. Although not shown in detail in the drawings, the platen support 103, to which the platen 104 is fixed, may be moved in the front-rear direction along the guide rails 102 by a platen drive mechanism, which includes a platen drive motor and a belt transmission mechanism.

A pair of guide rails 112 that extend in the left-right direction are provided above the platen 104 in a substantially center position in the front-rear direction of the housing 101. A carriage 113 is supported by the guide rails 112 such that it can move in the left-right direction along the guide rails 112. The print head 114 is fixed to a lower portion of the carriage 113. Although not shown in detail in the drawings, the carriage 113 provided with the print head 114 may be moved in the left-right direction along the guide rails 112 by a carriage drive mechanism, which includes a carriage drive motor and a belt transmission mechanism. The ink can be supplied to the print head 114 via a tube 182 (refer to FIG. 19) from the cartridge 1 that is set in the cartridge mounting portion 108 provided inside the housing 101. A plurality of fine nozzles are provided in a bottom surface of the print head 114. Droplets of the ink may be discharged downward from the nozzles by driving of piezoelectric elements, and thus printing may be performed on the fabric placed on the platen 104.

Eight cartridges 1 can be set in the printer 100, and eight cartridge mounting portions 108 are provided inside the housing 101. Note that only the cartridge mounting portion 108 on the right end is depicted in FIG. 1. Eight cartridge insertion ports 120 are provided in a lower right portion of a front surface of the housing 101. The cartridge insertion ports 120 are openings through which the cartridges 1 may be inserted into the cartridge mounting portions 108. The cartridge mounting portion 108 is a passage that is configured to guide the cartridge 1 inside the printer 100 such that the cartridge 1 is disposed in a state in which the ink can be supplied. A length of the cartridge mounting portion 108 in the front-rear direction is approximately one third of a length of the cartridge 1 in the front-rear direction. A length (width) of the cartridge mounting portion 108 in the left-right direction is slightly wider than a length (width), in the left-right direction, of the cartridge 1 that includes leg portions 301 to 305 (refer to FIG. 2) that will be described later. A length (height) of the cartridge mounting portion 108 in the up-down direction is slightly longer than a length (height) of the cartridge 1 in the up-down direction.

Note that, the four ink cartridges 1 for white ink, and the ink cartridges 1 that respectively store inks of four colors of cyan, magenta, yellow and black may be used in the printer 100 of the present embodiment. A method for mounting the cartridge 1 in the printer 100 and a method for supplying the ink from the cartridge 1 to the printer 100 will be described later.

The structure of the cartridge 1 will be explained with reference to FIG. 2 to FIG. 16. The cartridge 1 includes a plastic case 2 (refer to FIG. 2 and FIG. 3) that has a thin generally rectangular box shape and that is longer in the front-rear direction, and an ink pack 7 (refer to FIG. 12 and FIG. 13) that is housed in the case 2. Hereinafter, detailed structures of the case 2 and the ink pack 7 will be explained in order. Note that the ink cartridges 1 for five colors, i.e., white, cyan, magenta, yellow and black, are different only in the color of liquid ink stored in the ink pack 7 and in the arrangement of the first intermediate leg portion 303 and the second intermediate leg portion 304 to be described later, while the remaining structure is the same for all the ink cartridges 1.

Figure 6:
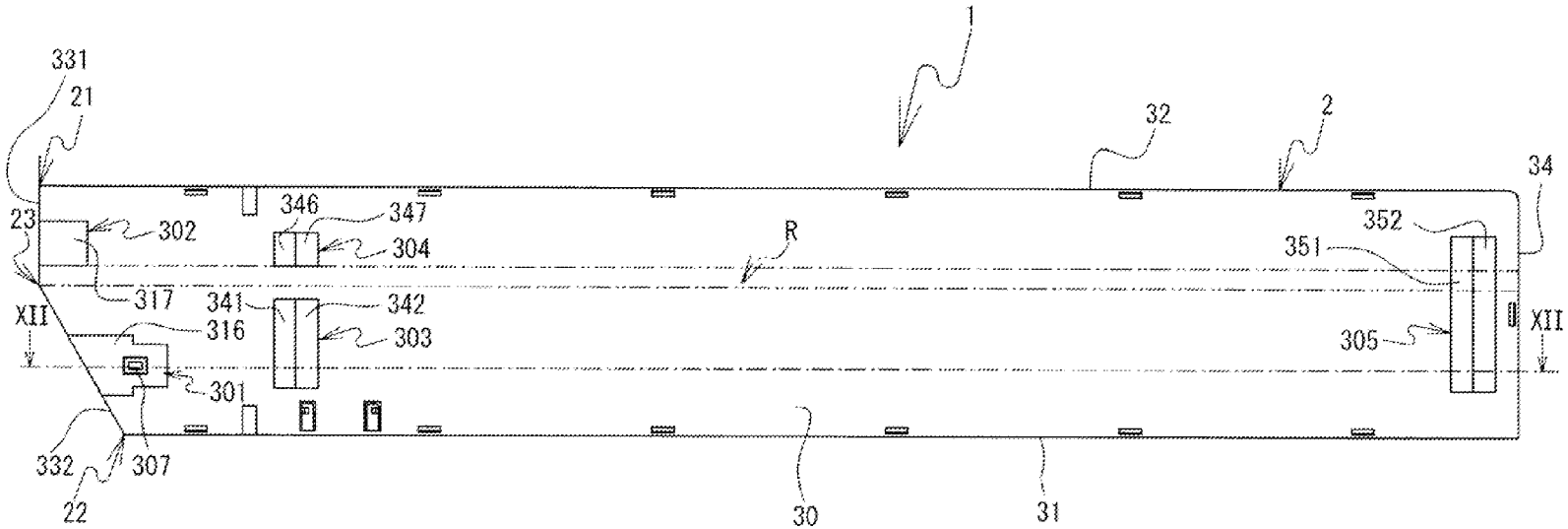
FIG. 6 is a left side view of the ink cartridge 1.
Figure 7:
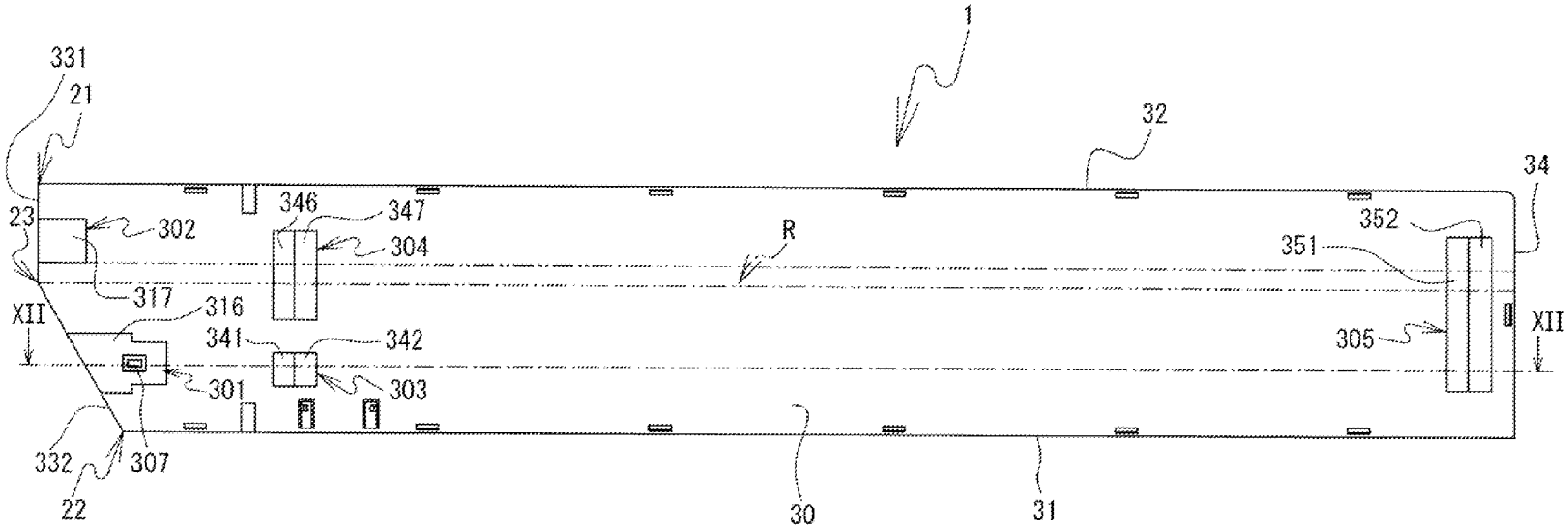
FIG. 7 is a left side view of the ink cartridge 1 having a first intermediate leg portion 303 and a second intermediate leg portion 304 that are arranged in different positions to the example shown in FIG. 6.
Figure 11:
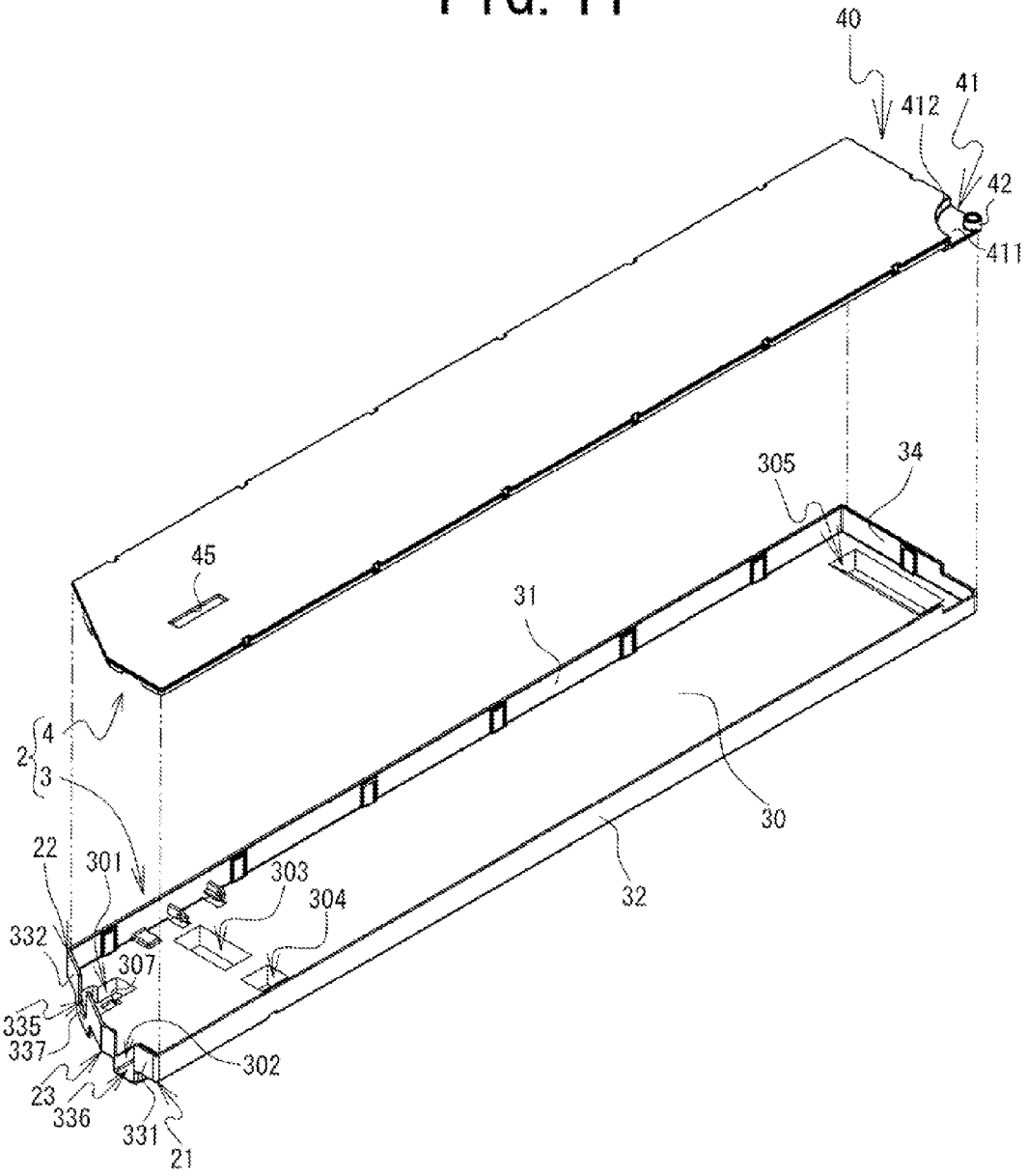
FIG. 11 is an exploded perspective view of a case 2.

First, an outline configuration of the case 2 as a whole will be explained. As shown in FIG. 11, the case 2 includes a body portion 3 and a lid portion 4. The body portion 3 includes a left wall 30, a bottom wall 31, a top wall 32, a rear wall 33 (refer to FIG. 2) and a front wall 34 that have a thin plate shape and respectively form a left side surface, a bottom surface, a top surface, a back surface and a front surface, which are outer surfaces of the case 2. In other words, the body portion 3 has a box shape that is open on the right side (the upper side in FIG. 11). Note that, hereinafter, the bottom wall 31, the top wall 32, the rear wall 33 and the front wall 34 are collectively referred to as the peripheral walls 31 to 34. As shown in FIG. 6, when the case 2 is seen in a side view from the left, namely, when it is seen from a direction that is orthogonal to a largest area portion (the surface shown in FIG. 6) of the left wall 30, the left wall 30 has a pentagonal shape. Specifically, the left wall 30 has such a shape that, among four corner portions that form right angles of a rectangle, a corner portion including a corner on the lower rear side of the case 2 (the lower left in FIG. 6) is diagonally cut out. More specifically, when the case 2 is seen in a side view, the left wall 30 has two long sides extending horizontally and in parallel to each other, two short sides extending in the up-down direction and in parallel to each other, and an oblique side that connects a shorter one of the two long sides and a shorter one of the two short sides.

As shown in FIG. 11, the bottom wall 31, the top wall 32, the rear wall 33 (refer to FIG. 2) and the front wall 34 respectively extend substantially perpendicular to the left wall 30 in a same direction and to a same length. The bottom wall 31 connects to a lower end portion of the left wall 30, namely, the shorter one of the pair of long sides. The top wall 32 connects to an upper end portion of the left wall 30, namely, a longer one of the pair of long sides. The rear wall 33 includes a back surface portion 331 and an inclined surface portion 332. The back surface portion 331 connects to the shorter one of the pair of short sides of the left wall 30. The inclined surface portion 332 connects to the oblique side of the left wall 30 and connects the bottom wall 31 and the back surface portion 331. The front wall 34 connects to a front end portion of the left wall 30, namely, a longer one of the short sides. The front wall 34 connects the bottom wall 31 and the top wall 32.

As shown in FIG. 11, the bottom wall 31 is a rectangular plate-shaped wall. The top wall 32 is a plate-shaped wall with an overall rectangular shape, of which part of a front right portion is cut out in a rectangular shape. The front wall 34 is a plate-shaped wall with an overall rectangular shape, of which part of an upper right portion is cut out in a rectangular shape. The back surface portion 331 and the inclined surface portion 332 each have a rectangular shape in which a central portion protrudes to the left wall 30 side. A spout opening 335 and a first exposure opening 336, which will be described later, are respectively provided in the back surface portion 331 and the inclined surface portion 332.

The top wall 32 and the back surface portion 331, the top wall 32 and the front wall 34, and the bottom wall 31 and the front wall 34 are respectively connected such that they form right-angled corners. On the other hand, a corner formed by the inclined surface portion 332 and the bottom wall 31, and a corner formed by the inclined surface portion 332 and the back surface portion 331 each has an obtuse angle. Hereinafter, a corner portion that is formed by the top wall 32 and the back surface portion 331, at one end on the upper side of the rear end portion of the case 2 is referred to as a first corner portion 21. A corner portion that is formed by the inclined surface portion 332 and the bottom wall 31, at the other end on the lower side of the rear end portion is referred to as a second corner portion 22. A corner portion that is formed by the inclined surface portion 332 and the back surface portion 331 is referred to as a third corner portion 23.

Figure 8:
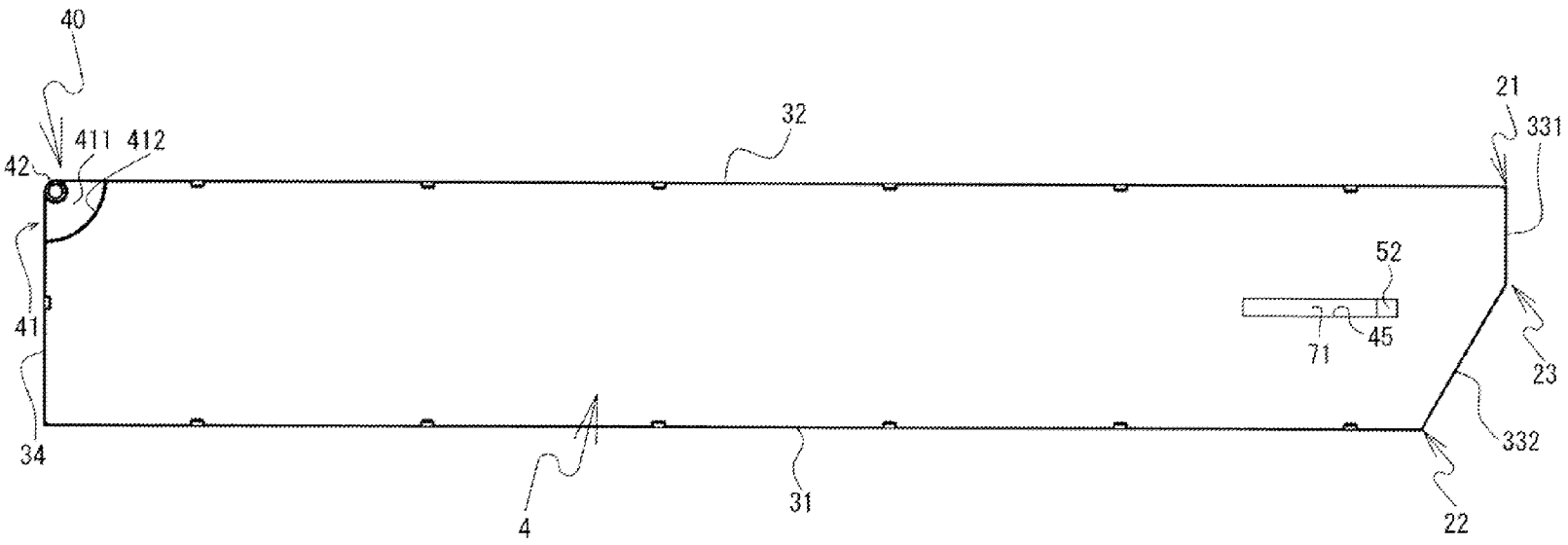
FIG. 8 is a right side view of the ink cartridge 1.

As shown in FIG. 11, the lid portion 4 is a thin plate-shaped member and has substantially the same shape as the left wall 30 of the body portion 3. The lid portion 4 faces the left wall 30 and forms a right side surface (an upper side surface in FIG. 11) of the case 2. As shown in FIG. 8, when the case 2 is seen in a side view from the right, namely, when it is seen from a direction that is orthogonal to a largest area portion (the surface shown in FIG. 8) of the lid portion 4, the lid portion 4 has a pentagonal shape. Specifically, the lid portion 4 has such a shape that, among four corner portions forming right angles of a rectangle that is longer in the horizontal direction, a corner portion including a corner on the lower rear side (the lower right in FIG. 8) of the case 2 is diagonally cut out. The lid portion 4 is joined to the body portion 3 to form the case 2. A method for joining the lid portion 4 to the body portion 3 is not particularly limited. Although not shown in the drawings, engagement hooks and engagement holes may be provided in the body portion 3 and the lid portion 4, respectively. The lid portion 4 may be joined to the body portion 3 by inserting the engagement hooks into the engagement holes. The lid portion 4 may be joined to the body portion 3 using engagement pins and the engagement holes, instead of using the engagement hooks. The body portion 3 and the lid portion 4 may be fixed by welding.

Figure 2:
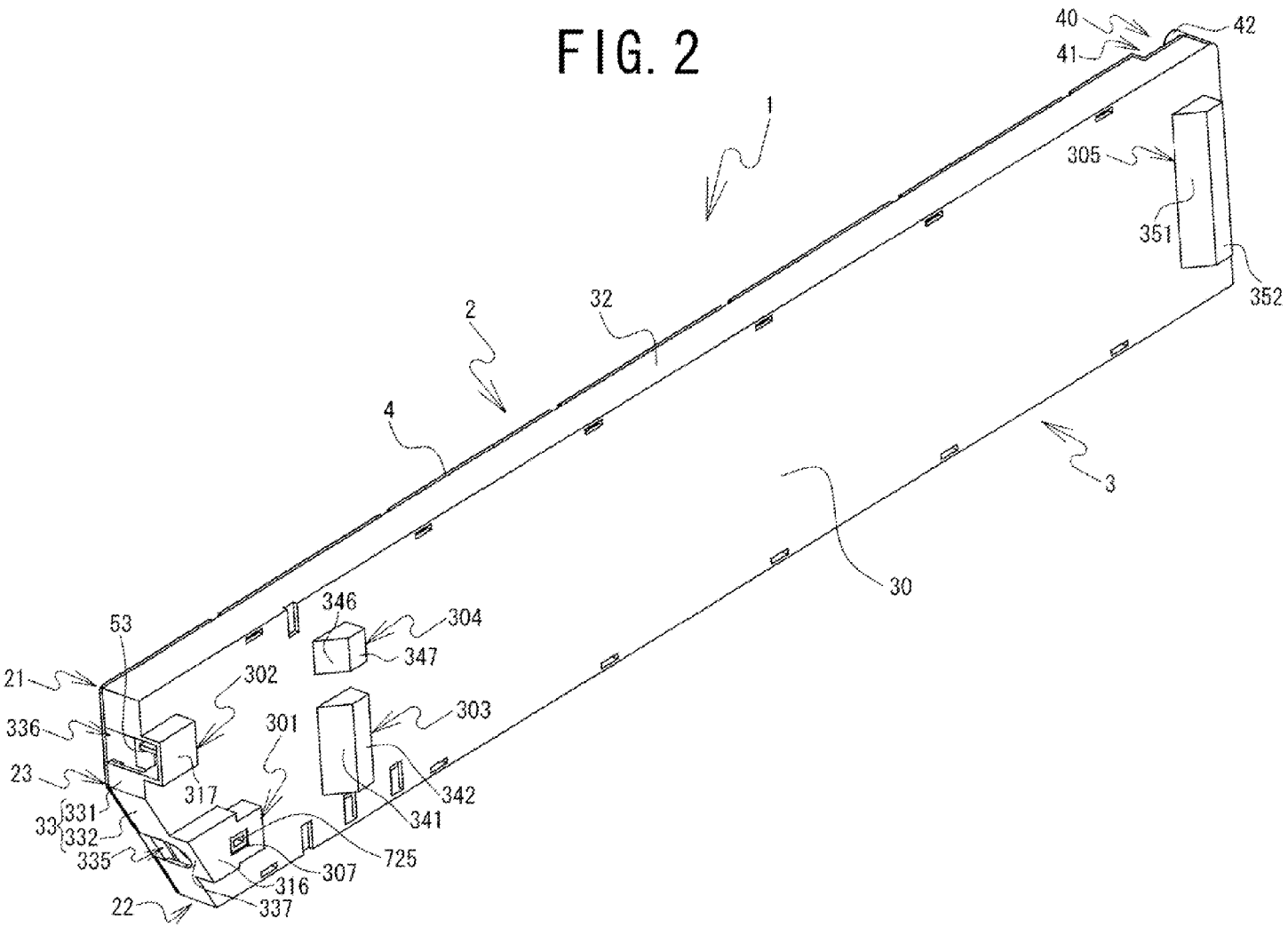
FIG. 2 is a perspective view of an ink cartridge 1 as viewed from the rear left.

Hereinafter, detailed portions of the case 2 will be explained in order. First, leg portions that are provided on the case 2 will be explained. As shown in FIG. 2, five protruding portions protruding from an outer surface (a left side surface of the case 2) are provided on the left wall 30. More specifically, two protruding portions, which are mutually separated in the up-down direction (in the direction in which the top wall 32 and the bottom wall 31 face each other), are provided in a rear end portion, which is one of two end portions positioned in the longitudinal direction of the left wall 30. Two protruding portions, which are mutually separated in the up-down direction, are provided in positions that are separated to the front from the protruding portions described immediately above. Further, a single protruding portion is provided in the vicinity of a front end portion that is positioned on the opposite side to the rear end portion in the longitudinal direction of the left wall 30.

The protruding portion that is provided, in the rear end portion of the left wall 30, on the oblique side portion that is connected to the inclined surface portion 332 is referred to as the first rear end leg portion 301. The protruding portion that is provided, in the rear end portion of the left wall 30, on the shorter one of the short sides (hereinafter referred to as a straight line portion) that connects to the back surface portion 331 is referred to as the second rear end leg portion 302. The protruding portion that is provided in a position separated from the first rear end leg portion 301 toward the front (toward the right in FIG. 6) is referred to as the first intermediate leg portion 303. The protruding portion that is provided in a position separated from the second rear end leg portion 302 toward the front is referred to as the second intermediate leg portion 304. The protruding portion in the vicinity of the front end portion of the left wall 30 is referred to as the front end leg portion 305. It should be noted that when the first rear end leg portion 301, the second rear end leg portion 302, the first intermediate leg portion 303, the second intermediate leg portion 304 and the front end leg portion 305 are collectively referred to, they are simply referred to as the leg portions 301 to 305. Further, when one or some of the first rear end leg portion 301, the second rear end leg portion 302, the first intermediate leg portion 303, the second intermediate leg portion 304 and the front end leg portion 305 are indicated, they are simply referred to, for example, as the leg portions 301 to 303 and so on.

Figure 9:
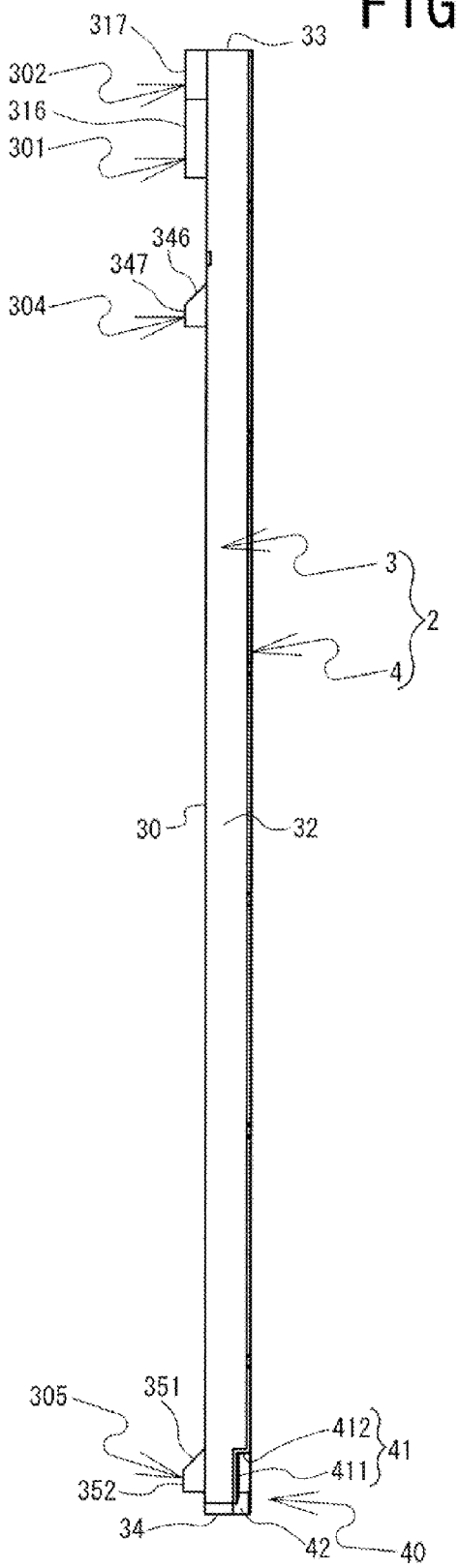
FIG. 9 is a top view of the ink cartridge 1.

The first rear end leg portion 301 is a wall portion that forms a space (a housing space) in which a spout 72 (refer to FIG. 12) of the ink pack 7 that will be described later is housed. As shown in FIG. 11, the first rear end leg portion 301 is formed by indenting, from an inner surface side, which faces the lid portion 4 when the body portion 3 and the lid portion 4 are joined together, to an outer surface side, an area of the left wall 30 that extends toward the front from the oblique side portion of the left wall 30 and that is slightly larger than a size of the spout 72. Thus, the first rear end leg portion 301 is a recessed portion when seen from inside the case 2, and is a protruding portion when seen from the outside of the case 2. Note that the first rear end leg portion 301 is in a position that is separated from the lower end portion of the left wall 30 (the end portion on the bottom wall 31 side). The first rear end leg portion 301 has a rectangular engagement hole 307 that is formed in a central portion of a bottom wall portion of the recessed portion as seen from the inside. The engagement hole 307 is an opening that is configured to position and fix the spout 72 (refer to FIG. 12) of the ink pack 7, which will be described later, to the body portion 3. Namely, the first rear end leg portion 301 may also function as a fixing portion for the spout 72. As shown in FIG. 2 and FIG. 9, a protruding surface of the first rear end leg portion 301 as seen from the outside forms a flat surface portion 316 that is substantially parallel to the outer surface of the left wall 30 (the left side surface of the case 2).

Figure 10:
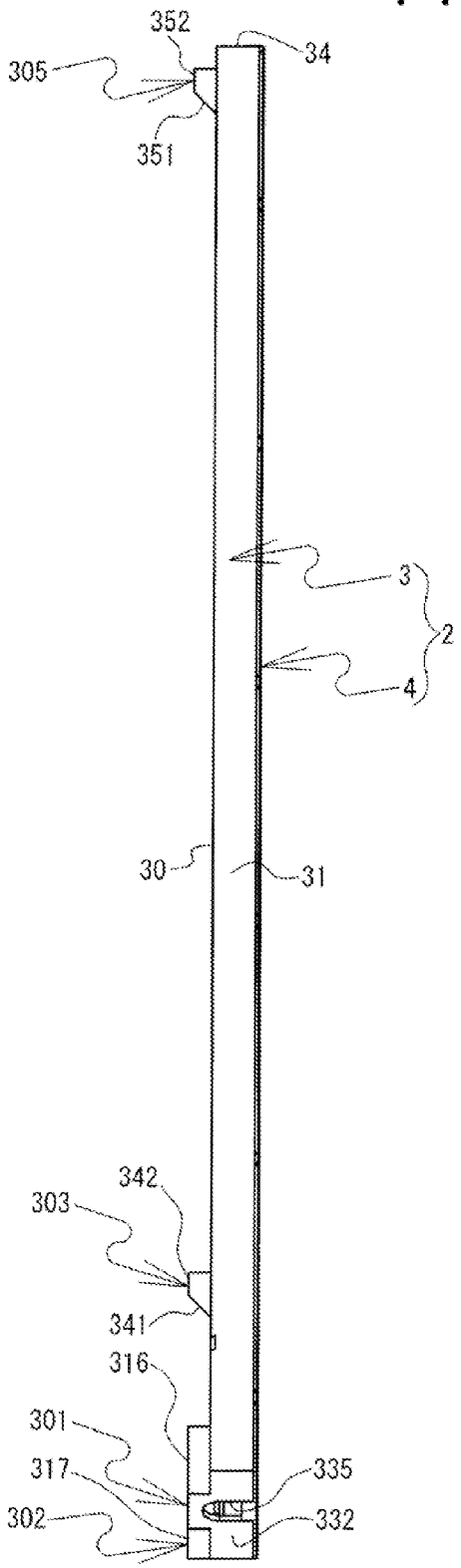
FIG. 10 is a bottom view of the ink cartridge 1.

The second rear end leg portion 302 is a wall portion that forms a space (a movement-enabling space) in which an internal component arranged inside the case 2 can move, specifically, in which a part of a movable member 50 (refer to FIG. 15) to be described later can move. As shown in FIG. 11, the second rear end leg portion 302 is formed by indenting, from the inner surface side of the left wall 30 toward the outer surface side, a specific area that extends toward the front from the straight line portion of the rear end portion of the left wall 30. Note that, in the present embodiment, the specific area that forms the second rear end leg portion 302 is slightly smaller than the area of the first rear end, leg portion 301 that corresponds to the size of the spout 72. However, this specific area may be set in accordance with a movable range of the movable member 50. Similarly to the first rear end leg portion 301, the second rear end leg portion 302 is a recessed portion when seen from inside the case 2, and is a protruding portion when seen from the outside of the case 2. Note that the second rear end leg portion 302 is in a position that is separated from the upper end portion of the left wall 30 (the end portion on the side of the top wall 32). As shown in FIG. 2 and FIG. 10, a protruding surface of the second rear end leg portion 302 as seen from the outside forms a flat surface portion 317 that is substantially parallel to the outer surface of the left wall 30 (the left side surface of the case 2).

As shown in FIG. 6, the first intermediate leg portion 303 and the second intermediate leg portion 304 are provided in substantially a same position in the longitudinal direction of the left wall 30 (the front-rear direction of the left wall 30, the left-right direction in FIG. 6). In the present embodiment, the first intermediate leg portion 303 and the second intermediate leg portion 304 are arranged significantly closer to the rear end portion (the left side end portion in FIG. 6) from the center, in the front-rear direction of the left wall 30. The first intermediate leg portion 303 and the second intermediate leg portion 304 are in positions that are separated from the first rear end leg portion 301 and the second rear end leg portion 302 toward the front (toward the right in FIG. 6). In the case 2, as shown in FIG. 6 and so on, a length of the first intermediate leg portion 303 in the up-down direction (the direction in which the top wall 32 faces the bottom wall 31, the up-down direction in FIG. 6) is longer than a length of the second intermediate leg portion 304 in the up-down direction. Further, the first intermediate leg portion 303 and the second intermediate leg portion 304 are separated from each other in the up-down direction, and the second intermediate leg portion 304 is positioned above (on the top wall 32 side) the first intermediate leg portion 303. The lower edge (the edge on the bottom wall 31 side) of the first intermediate leg portion 303 is positioned above the lower edge of the first rear end leg portion 301, and the upper edge (the edge on the side of the top wall 32) of the second intermediate leg portion 304 is positioned below the upper edge of the second rear end leg portion 302.

As shown in FIG. 11, the first intermediate leg portion 303 and the second intermediate leg portion 304 are also formed by indenting part of the left wall 30 from the inner surface side to the outer surface side. In other words, similarly to the first rear end leg portion 301 and the second rear end leg portion 302, the first intermediate leg portion 303 and the second intermediate leg portion 304 are recessed portions when seen from the inside of the case 2 and are protruding portions when seen from the outside of the case 2.

The first intermediate leg portion 303 and the second intermediate leg portion 304 may function as a color indicator portion that indicates the color of the ink stored in the ink pack 7 inside the case 2. Specifically, ranges of the left wall 30 in which the first intermediate leg portion 303 and the second intermediate leg portion 304 may be respectively provided are set in accordance with the ink color. In the present embodiment, the cartridge 1 is categorized into two types, namely, a type in which the ink color is white and a type in which the ink color is cyan, magenta, yellow or black (hereinafter referred to as "other than white"). The first intermediate leg portion 303 and the second intermediate leg portion 304 are provided in different ranges depending on whether the ink color is white or is other than white.

More specifically, as shown in FIG. 6, a band-shaped area that extends from the lower edge (the end on the third corner portion 23 side) of the second rear end leg portion 302 and from the third corner portion 23 along the longitudinal direction of the left wall 30 toward the front (toward the right in FIG. 6) is a determination area R. For example, when the ink color is white, the first intermediate leg portion 303 and the second intermediate leg portion 304 are arranged such that they do not extend into the determination area R, as in the example shown in FIG. 6. Thus, in this example, the second intermediate leg portion 304 is formed having a length in the up-down direction that is shorter than the first intermediate leg portion 303. On the other hand, when the ink color is other than white, one of the first intermediate leg portion 303 and the second intermediate leg portion 304 is arranged such that it extends into the determination area R. Thus, in this case, as shown in an example in FIG. 7, the second intermediate leg portion 304 may be formed to be longer in the up-down direction than the example shown in FIG. 6, such that it crosses the determination area R, and the first intermediate leg portion 303 may be formed to be shorter.

To express the above-described arrangement conditions in a different way, the leg portions that may function as the color indicator portion may be provided in such a way that it makes it possible to determine whether the ink color is white or other than white by the presence or absence of the leg portion in the determination area R. In consequence, an arrangement relationship between the first intermediate leg portion 303 and the second intermediate leg portion 304 is not limited to the above-described example. For example, when the ink color is white, only the first intermediate leg portion 303 may be provided, in a range that does not extend into the determination area R. Further, when the ink color is other than white, one of either the first intermediate leg portion 303 or the second intermediate leg portion 304 may be provided in a range that crosses the determination area R, or both the first intermediate leg portion 303 and the second intermediate leg portion 304 may be provided.

In this way, by prescribing the ranges in which the leg portions that may function as the color indicator portion may be provided, a user can visually verify the presence or absence of the leg portion that extends into the determination area R of the left wall 30 and determine whether the color of the ink stored inside the case 2 is white or other than white. Note that, as the determination area R is a band-shaped area that extends from the lower edge of the second rear end leg portion 302 and from the third corner portion 23 toward the front of the case 2, the user can use the lower edge of the second rear end leg portion 302 and the third corner portion 23 as markers and can thus easily recognize the position of the determination area R. As a result, the user can easily recognize whether or not the leg portion extends into the determination area R. In the printer 100 shown in FIG. 1, four of the eight cartridge mounting portions 108 are for white ink and the other four are for inks that are other than white. By providing the color indicator portion in this way, it is therefore possible to reduce a risk that the user mistakenly mounts the cartridge 1 storing white ink into the cartridge mounting portion 108 for ink that is other than white, or mistakenly mounts the cartridge 1 storing ink that is other than white into the cartridge mounting portion 108 for white ink.

As shown in FIG. 6, the front end leg portion 305 is provided in the vicinity of the front end portion of the left wall 30 (the end portion on the right side in FIG. 6) and in a position that is separated from the front end portion. In the case 2 that is shown in FIG. 6 and so on, the positions of the upper edge and the lower edge of the front end leg portion 305 are the same, respectively, as the positions of the upper edge of the second intermediate leg portion 304 and the loser edge of the first intermediate leg portion 303. As shown in FIG. 11, the front end leg portion 305 is also formed by indenting a part of the left wall 30 from the inner surface side toward the outer surface side. In other words, similarly to the leg portions 301 to 304, the front end leg portion 305 is a recessed portion when seen from the inside of the case 2 and is a protruding portion when seen from the outside of the case 2.

Further, as shown in FIG. 2, when seen from the outside of the case 2, the leg portions 303 to 305 respectively have flat surface portions 342, 347 and 352 that are substantially parallel to the outer surface of the left wall 30 (the left side surface of the case 2). The leg portions 303 to 305 also have inclined surface portions 341, 346 and 351 that incline toward the outer surface of the left wall 30 from the flat surface portions 342, 347 and 352, respectively. The inclined surface portions 341, 346 and 351 are formed such that the protrusion height of the leg portions 303 to 305 becomes gradually larger from the rear end side of the left wall 30 toward the front end side. The rear end side of the left wall 30 is the side that is mounted into the printer 100 first. The front end side of the left wall 30 is the side that is mounted into the printer 100 later. In the present embodiment, as shown in FIG. 9 and FIG. 10, the leg portions 301 to 305 have the same height of protrusion from the outer surface of the left wall 30. In other words, the flat surface portions 316, 317, 342, 347 and 352 of the leg portions 301 to 305 are in the same plane.

Other operations and effects of the leg portions 301 to 305 of the cartridge 1 will be explained. As described above, all of the leg portions 301 to 305 protrude from the outer surface of the left wall 30 toward the outside of the case 2. The leg portions 301 to 305 have the same protrusion height and protrusion surfaces of the leg portions 301 to 305 are in the same plane. Thus, if the cartridge 1 is placed on a flat surface in a state in which the left wall 30, from which the leg portions 301 to 305 protrude, is on the lower side and the lid portion 4 is on the upper side, the flat surface portions 316, 317, 342, 347 and 352 contact the flat surface and the cartridge 1 may be held in a stable manner by the leg portions 301 to 305 while the left wall 30 as a whole is separated from the flat surface.

As shown in FIG. 6, the first rear end leg portion 301 and the second rear end leg portion 302 that are provided on the rear end portion of the left wall 30 are mutually separated from each other. In addition, the first rear end leg portion 301 and the second rear end leg portion 302 are in positions that are separated from the lower end portion and the upper end portion of the left wall 30, respectively. As a result, the user can insert his/her finger into a gap that is formed between the flat surface and the left wall 30 around these leg portions, from the lower end portion or the upper end portion of the left wall 30, or between the first rear end leg portion 301 and the second rear end leg portion 302 of the rear end portion of the left wall 30, and can thus easily pick up the cartridge 1. In addition, the first rear end leg portion 301 is provided on the oblique side portion of the left wall 30 corresponding to the inclined surface portion 332, and the second rear end leg portion 302 is provided on the straight line portion corresponding to the back surface portion 331. As a result, the positions of the first rear end leg portion 301 and the second rear end leg portion 302 are displaced in the longitudinal direction of the left wall 30. Thus, a separation distance is longer than a case in which the first rear end leg portion 301 and the second rear end leg portion 302 are both provided on the straight line portion. In other words, the first rear end leg portion 301 and the second rear end leg portion 302 are structured such that a finger may be easily inserted between them.

The leg portions 303 to 305 are also in positions that are respectively separated from any of the end portions of the left wall 30. Thus, around these leg portions also, the user can insert his/her finger from the lower end portion, the upper end portion or the front end portion of the left wall 30 into a gap that is formed between the flat surface and the left wall 30, and can thus easily pick up the cartridge 1.

On the other hand, if the cartridge 1 is placed on the flat surface with the lid portion 4 on the lower side and the left wall 30 on the upper side, the user can grip at least one of the leg portions 301 to 305 with his/her fingers, or can hook his/her finger around at least one of the leg portions 301 to 305 to move the cartridge 1, and thus the degree of freedom in handling the cartridge 1 may be improved. Note that, as described above, the leg portions 301 to 304 may have the functions other than the function to support the cartridge 1 in a state in which the left wall 30 is separated from the flat surface. In this way, a plurality of different functions may be fulfilled by the same structural member, and thus, in comparison to a case in which dedicated structural members are individually provided, a simplified structure can be achieved.

Figure 5:
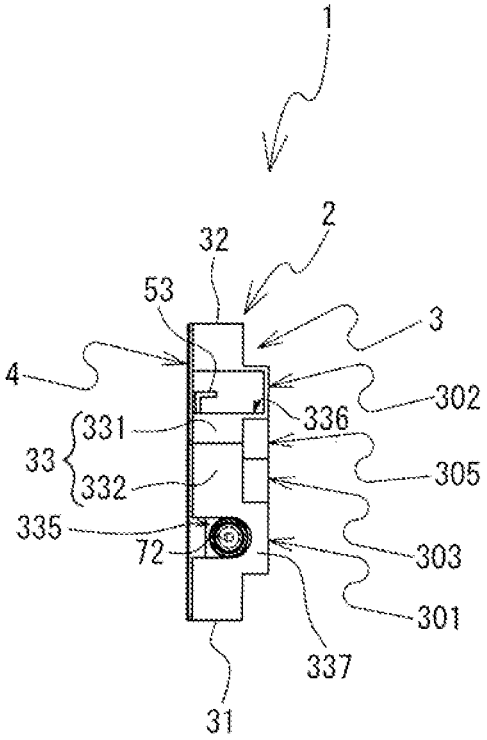
FIG. 5 is a rear view of the ink cartridge 1.

Various openings provided in the case 2 will be explained below. As shown in FIG. 2 and FIG. 5, two openings are provided in the rear wall 33 of the case 2. Specifically, the spout opening 335 is provided in the inclined surface portion 332, in a position corresponding to the first rear end leg portion 301. Further, the first exposure opening 336 is provided in the back surface portion 331, in a position corresponding to the second rear end leg portion 302. As shown in FIG. 11, the spout opening 335 is a recessed portion that is formed in the inclined surface portion 332 and that extends toward the left wall 30 from an end portion (an upper end portion in FIG. 11) on the side on which the inclined surface portion 332 is joined to the lid portion 4. When seen from a direction that is orthogonal to the inclined surface portion 332, the spout opening 335 has a U shape. The spout opening 335 does not reach as far as a bottom wall section of the first rear end leg portion 301 that is provided as the recessed portion in the left wall 30. Thus, a part of the inclined surface portion 332 remains as a connecting wall portion 337 between a connecting portion of the bottom wall section and the inclined surface portion 332, and the end of the spout opening 335 on the left wall 30 side. As will be explained in more detail later, the spout opening 335 is an opening through which the ink can be drawn out from the ink pack 7 (refer to FIG. 13) that is housed inside the case 2. The ink pack 7 is arranged inside the case 2 such that the spout 72 faces the spout opening 335.

As shown in FIG. 11, the first exposure opening 336 is a recessed portion that is formed in the back surface portion 331 and that extends toward the left wall 30 from an end portion (an upper end portion in FIG. 11) on the side on which the back surface portion 331 is joined to the lid portion 4. When seen from a direction that is orthogonal to the back surface portion 331, the first exposure opening 336 has a rectangular shape. The first exposure opening 336 reaches a bottom wall section of the second rear end leg portion 302 that is provided as the recessed portion in the left wall 30. In other words, the first exposure opening 336 is an opening that extends over the whole width of the back surface portion 331 in the left-right direction (the up-down direction in FIG. 11). As will be explained in more detail later, the first exposure opening 336 is an opening that is configured to expose an exposed portion 53 that is a part of the movable member 50 (refer to FIG. 15) and allow the user to verify a position of the exposed portion 53.

Figure 3:
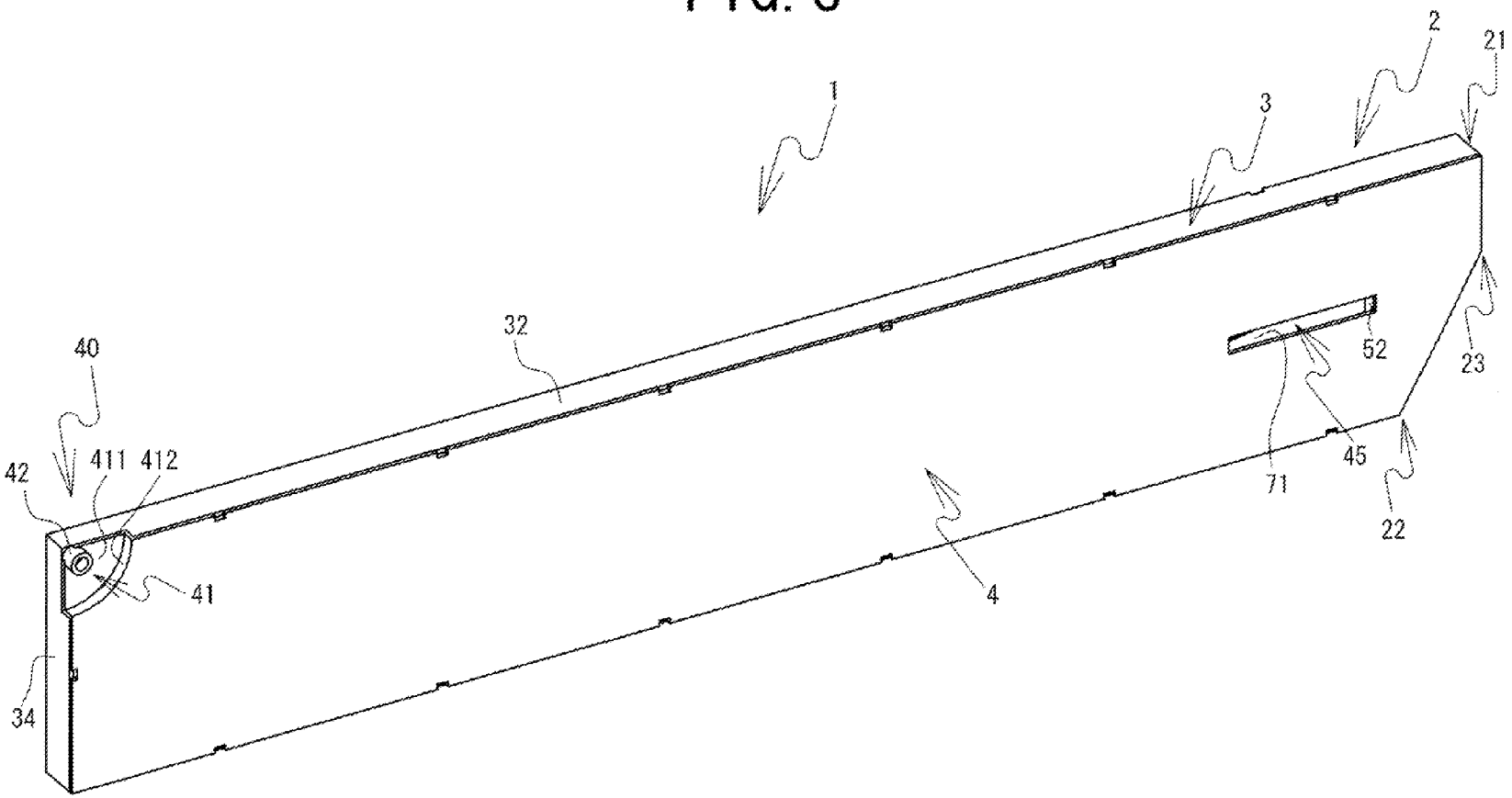
FIG. 3 is a perspective view of the ink cartridge 1 as viewed from the front right.

In addition, as shown in FIG. 3 and FIG. 8, a slit-shaped second exposure opening 45 is provided in the vicinity of the rear end portion (the end portion on the right side in FIG. 8) of the lid portion 4. The second exposure opening 45 extends along the longitudinal direction (the left-right direction in FIG. 8) of the lid portion 4. A part of an arm portion 52, which is a part of the movable member 50 (refer to FIG. 15) and a part of an ink bag 71 of the ink pack 7 (refer to FIG. 13) that is housed in the case 2 can be seen through the second exposure opening 45. Thus, when the lid portion 4 of the cartridge 1 is facing upward, the user can visually check the ink bag 71 through the second exposure opening 45 and can thus verify the ink color or the remaining amount of the ink (such as whether the ink has almost been used up or whether a certain amount still remains) etc. Further, because an operator can check whether or not the arm portion 52 can be seen through the second exposure opening 45 at a time of manufacture of the cartridge 1, the operator can be inhibited from forgetting to attach the movable member 50.

A handle portion 40 that is provided on the case 2 will be explained below. As shown in FIG. 3, the handle portion 40 is provided on the upper right corner portion (the upper left corner portion of the lid portion 4 in FIG. 3) on the front end portion of the case 2. The handle portion 40 includes a recessed portion 41, which is recessed further toward the inner side of the case 2 than the right side surface, and a protruding portion 42 that protrudes from the recessed portion 41.

Figure 4:
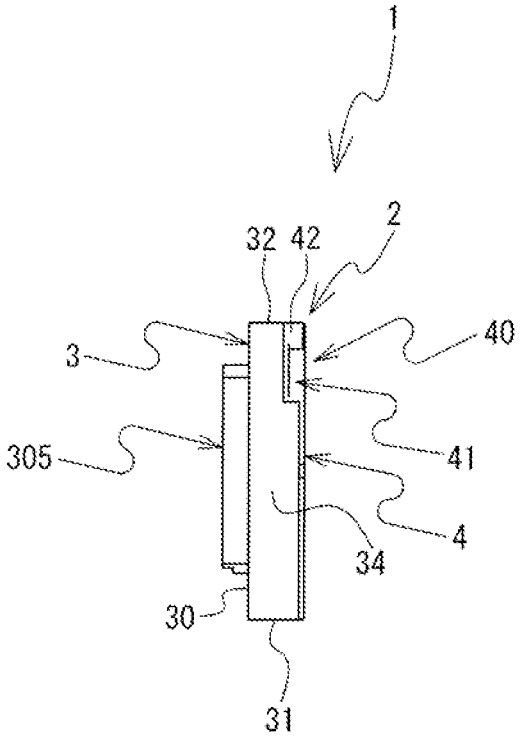
FIG. 4 is a front view of the ink cartridge 1.

The recessed portion 41 of the present embodiment is formed by indenting a fan-shaped area of the corner portion on the upper portion (the upper left in FIG. 8) of the lid portion 4 that is on the front end portion side of the case 2. The fan-shaped area is indented from the outer surface of the lid portion 4 (the right side surface of the case 2, the right side surface in FIG. 9) toward the inside of the case 2, namely, it is indented toward the left wall 30 that faces the lid portion 4. Thus, as shown in FIG. 8, when seen from a direction that is orthogonal to the outer surface of the lid portion 4, the recessed portion 41 includes a fan-shaped bottom portion 411 that forms the bottom surface of the recessed portion, and a peripheral wall portion 412 that is a wall portion which curves in an arc-shape and rises from the lid portion 4 along the arc-shaped edge of the bottom portion 411. As shown in FIG. 4, the upper right corner portion of the front wall 34 of the body portion 3, which corresponds to the recessed portion 41, is cut out in a rectangular shape. As shown in FIG. 9, the corner portion on the right side of the front end portion of the top wall 32, which corresponds to the recessed portion 41, is cut out in a rectangular shape. As a result, the recessed portion 41 is formed as a portion that is indented more toward the inside of the case 2 than the right side surface, the front surface and the top surface of the outer surface of the case 2, and is open in three directions to the right, to the front and upward.

As shown in FIG. 3 and FIG. 8, the protruding portion 42 is provided in a position corresponding to a hinge of the fan in the fan-shaped bottom portion 411, namely, on the front upper corner of the lid portion 4. As shown in FIG. 4, the protruding portion 42 protrudes from the bottom portion 411 of the recessed portion 41 toward the right side surface side of the case 2. In other words, the protruding portion 42 protrudes to the right. A protrusion height of the protruding portion 42 from the bottom portion 411 is equal to or less than a distance from the bottom portion 411 to the right side surface of the case 2 (the right side surface of the lid portion 4 in FIG. 4). Namely, the protruding portion 42 does not protrude from the right side surface of the case 2. In this way, even if a plurality of the cartridges 1 are arranged side by side without any gaps, or are stacked on top of each other, there is no interference between the protruding portion 42 and the outer surface of the neighboring cartridge 1. The protruding portion 42 of the present embodiment is a cylinder-shaped shaft portion that has a hollow portion that has a ring-shaped cross-section, and is formed integrally with the lid portion 4, along with the recessed portion 41. A cylinder-shaped wall that forms the protruding portion 42 is connected to the bottom portion 411.

The handle portion 40 with this type of structure may be useful when the user picks up a selected one of the cartridges 1, in a state in which a plurality of the cartridges 1 are arranged side by side without any gaps, or with only slight gaps between them, in particular. The reason is that gaps may be secured in three directions in the upper right corner on the front end portion of the case 2 by the recessed portion 41, and the protruding portion 42 may provide the part that can be hooked by a finger etc. The effects of the handle portion 40 when picking up one of the plurality of cartridges 1 that are arranged side by side will be explained later.

Figure 13:
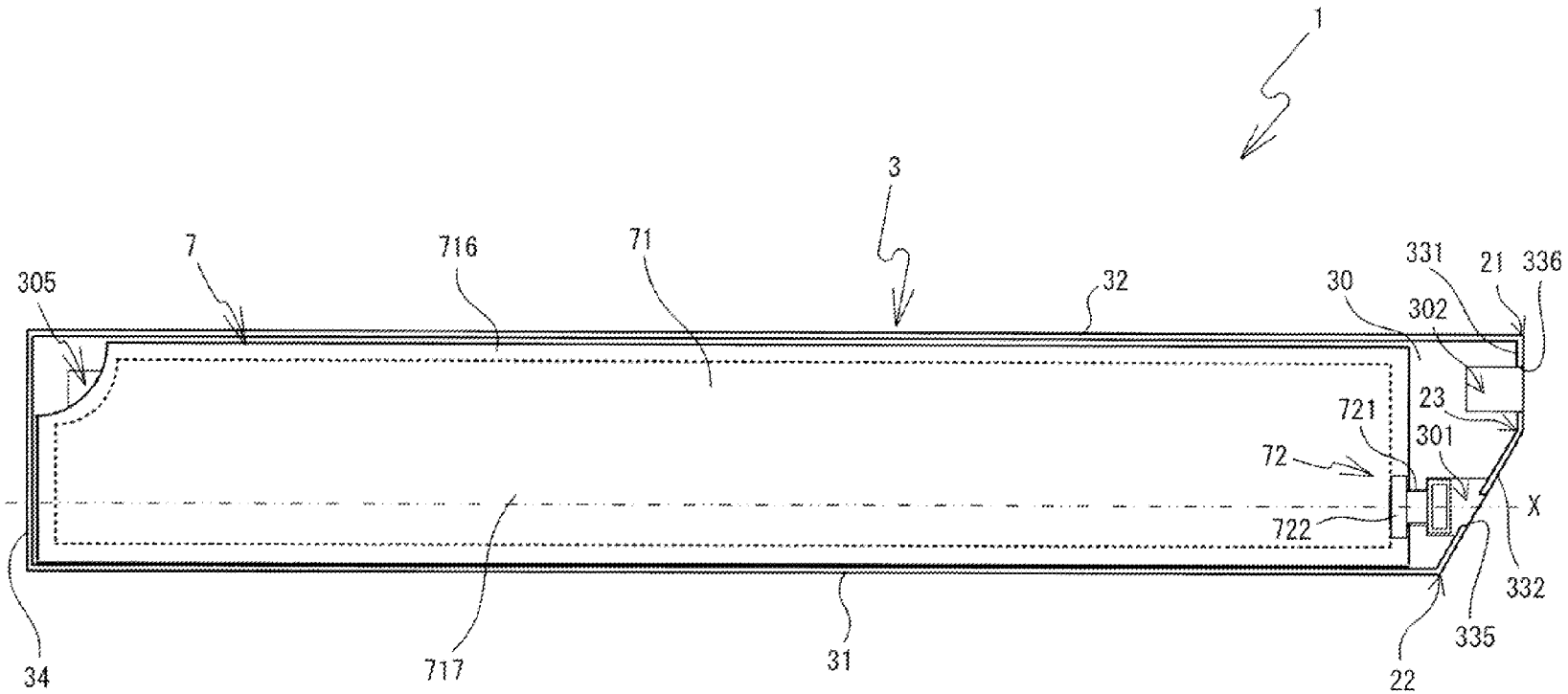
FIG. 13 is an explanatory diagram showing the ink cartridge 1 as viewed from the right side in a state in which a lid portion 4 is removed.

The structure of the ink pack 7 that is housed inside the case 2 will be explained. As shown in FIG. 13, the ink pack 7 is housed in a region that is surrounded by the peripheral walls 31 to 34 of the body portion 3. The ink pack 7 includes the ink bag 71 that stores ink, and the spout 72 that is provided on the ink bag 71. The ink bag 71 of the present embodiment is a bag-shaped container that is formed in the following manner. Two rectangular-shaped flexible plastic sheets are overlapped with each other such that one of surfaces of each of the sheets faces each other, and a surrounding portion 716 along four sides is thermally welded (heat sealed). The ink is stored inside an ink storage portion 717 that is a space surrounded by the surrounding portion 716. The ink storage portion 717 has a generally rectangular shape when seen from a direction that is orthogonal to a sheet surface, namely, a largest area portion (the surface shown in FIG. 13) of the sheet surface. Note that a corner portion of the ink bag 71 that corresponds to the handle portion 40 (refer to FIG. 8) of the case 2 only is cut out in an arc shape. The sheet surfaces of the ink storage portion 717 extend along inner surfaces of the left wall 30 and the lid portion 4 (refer to FIG. 11).

Note that the ink bag 71 may be configured in any manner as far as the ink bag 7 includes two layers of flexible sheets that are disposed to face each other and the ink bag 71 is a bag-shaped container in which a space is formed between the sheets that can store ink. Therefore, for example, the ink bag 71 may be formed such that one rectangular sheet is folded in half to form two layers, and the two layers are joined along three sides other than a folded portion. Two sheets that face each other may be joined along three sides of the two sheets and the remaining one side of each of the two sheets may be joined to another sheet, thus forming the ink bag 71 having a bottom portion. The ink bag 71 may be formed such that four sides of two sheets that face each other are respectively joined to other sheets serving as gussets. A method for joining the sheets is not limited to welding and any other method such as adhesive bonding, for example, may be used.

As shown in FIG. 13, the spout 72 includes a body portion 721 and connection portions 722. The connection portions 722 are two blade-shaped members that protrude in directions opposite to each other from an outer peripheral surface of the body portion 721, and are provided on one end side of the body portion 721. The body portion 721 is substantially cylindrically shaped, but an outer shape of a tip end that is on the opposite side of the body portion 721 to the one end side on which the connection portions 722 are provided is formed as a rectangular block. The spout 72 is provided on the ink bag 71 such that an axial line X of the body portion 721 (more precisely, a hollow portion 700 that will be described later) is substantially in parallel with a longitudinal direction of the ink bag 71. The axial line X is located closer to one end portion of the ink bag 71 that is positioned in a direction (a lengthwise direction of the ink bag 71) that is orthogonal to the axial-line X. In the present embodiment, the spout 72 is provided in the vicinity of one of four corner portions of the ink bag 71, namely in the vicinity of the corner portion that is positioned diagonally opposite to the arc-shaped corner portion. In the present embodiment, the spout 72 is fixed to the ink bag 71 such that the one end portion of the body portion 721 that includes the connection portions 722 is inserted between the two sheets that form the ink bag 71, and welded integrally with the surrounding portion 716. Other sections of the body portion 721 that are not welded with the surrounding portion 716 protrude to the outside of the ink bag 71 from one end portion of the ink bag 71 that is positioned in the longitudinal direction.

Figure 12:
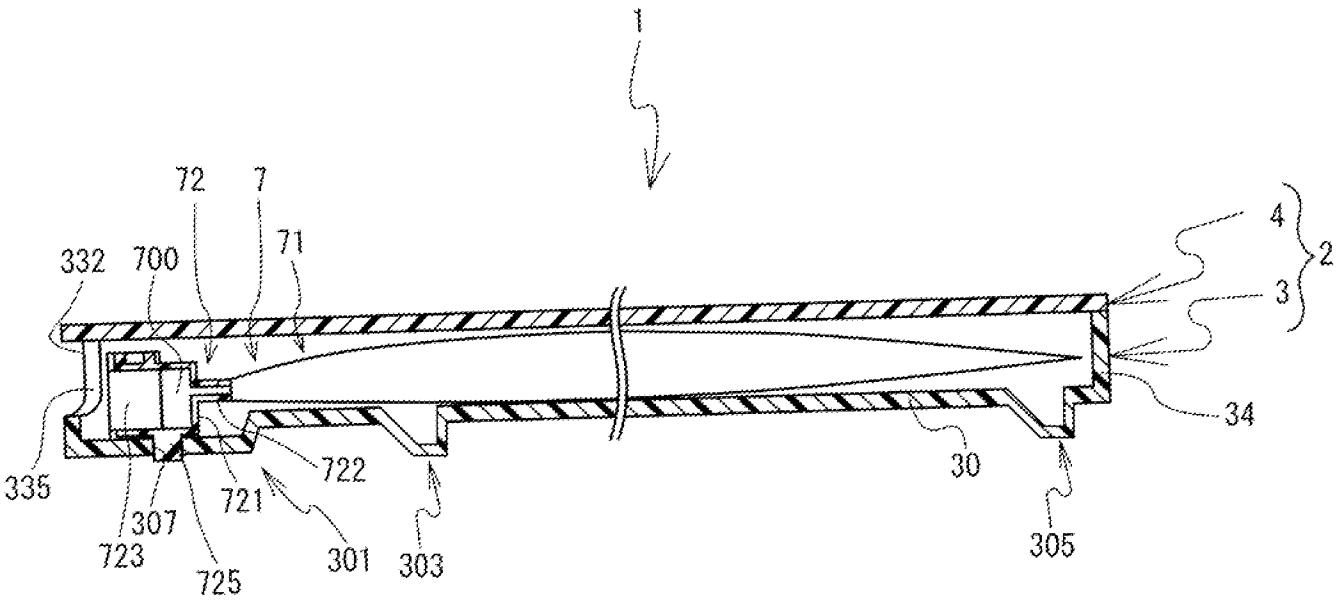
FIG. 12 is a cross-sectional view as viewed in the direction of the arrows on the line XII-XII shown in FIG. 6.
Figure 14:
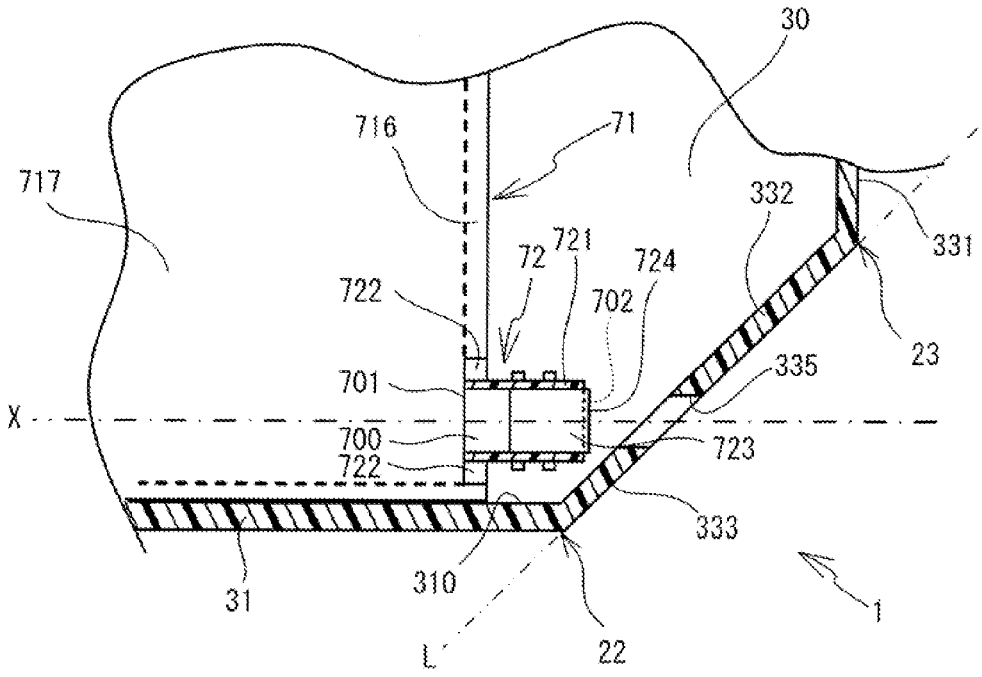
FIG. 14 is an enlarged vertical cross-sectional view of a spout 72 and its surrounding area of the ink cartridge 1.

As shown in FIG. 14, the body portion 721 includes the hollow portion 700 inside. The hollow portion 700 leads from a first opening 701 to a second opening 702. The first opening 701 is communicatively connected to the ink storage portion 717 of the ink bag 71. The second opening 702 opens to the outside of the ink bag 71. A cylindrical rubber plug 723 is inserted into an end portion on the second opening 702 side of the hollow portion 700. Therefore, the second opening 702 is closed by the rubber plug 723. In this manner, the ink is stored in the ink storage portion 717 in a sealed state. Note that the spout 72 may be configured in any manner as far as the spout 72 is provided on the ink bag 71 such that the ink storage portion 717 may communicate with the outside through the hollow portion 700, and a method for fixing the spout 72 is not limited to welding. Therefore, for example, the spout 72 may be formed integrally with the ink bag 71. Further, as shown in FIG. 12, an engaging projection 725 is provided on the section of the spout 72 that is formed as the rectangular block. The engaging projection 725 has a prismatic shape and protrudes radially outward. The engaging projection 725 is a member that is configured to position and fix the spout 72 with respect to the body portion 3 (specifically, with respect to the left wall 30).

An arrangement relationship between the case 2 and the ink pack 7 will be explained in detail with reference to FIG. 12 to FIG. 14. As shown in FIG. 12, the ink pack 7 is arranged in the case 2 such that the spout 72 is housed inside the recessed portion that forms the first rear end leg portion 301. The engaging projection 725 of the spout 72 is fitted into the engagement hole 307 provided in the first rear end leg portion 301, and thus the spout 72 is fixed to the body portion 3. Note that, in the present embodiment, a sheet surface of the ink bag 71 that faces the inner surface of the left wall 30 is partly bonded to the inner surface of the left wall 30 and thus the ink pack 7 is reliably fixed inside the body portion 3. By using the first rear end leg portion 301 as the housing space for the spout 72, the width (the distance from the right side surface to the left side surface) of the case 2 can be kept as narrow as possible, while only the section in which the spout 72 is placed is made wider in accordance with the diameter of the spout 72. As a result, it is possible for the whole body of the case 2 to be as thin as possible and to have a compact shape. Further, the ink pack 7 is fixed not to the lid portion 4, but to the body portion 3 on which the leg portions 301 to 305 are provided, and thus, as shown in FIG. 12, the cartridge 1 may have a stable posture when the cartridge 1 is placed on a flat surface with the left wall 30 on the lower side.

As shown in FIG. 13, the ink pack 7 is housed in the case 2 such that the axial line X of the spout 72 substantially matches the longitudinal direction of the case 2. As shown in FIG. 14, in the direction of the axial line X of the spout 72, the ink pack 7 is housed in the case 2 such that the second corner portion 22 of the case 2 is located on the first opening 701 side with respect to a leading end portion 724 (a leading end portion of the rubber plug 723) on the second opening 702 side of the spout 72. Further, the third corner portion 23 is located on an opposite side to the first opening 701 with respect to the leading end portion 724. A line L that connects the second corner portion 22 and the third corner portion 23 with the shortest distance diagonally intersects the axial line X. The bottom wall 31 extends from the second corner portion 22 in the direction of the axial line X of the spout 72. A rear end portion of the bottom wall 31 (a portion on the front side of the second corner portion 22, a left side portion in FIG. 14) that is located below the spout 72 is referred to as a receiving surface portion 310. The receiving surface portion 310 may function as a surface portion to receive ink leaking from the spout 72 below the spout 72.

The ink pack 7 is disposed such that the leading end portion 724 of the spout 72 is located on the inner side of the case 2 with respect to the line L. In the direction of the axial line X, the leading end portion 724 is located with a clearance from the inner surface (the left surface in FIG. 14) of the inclined surface portion 332. Therefore, the ink that has leaked can move between the inclined surface portion 332 and the leading end portion 724 (below the leading end portion 724 in FIG. 14). In the present embodiment, the inclined surface portion 332 is provided between the second corner portion 22 and the third corner portion 23, and an outer surface 333 of the inclined surface portion 332 is on the line L. Further, the leading end portion 724 is located on the inner side with respect to the inner surface of the inclined surface portion 332. However, it may be sufficient that the leading end portion 724 be positioned at least on the inner side of the case 2 with respect to the line L (the outer surface 333). A section of the inclined surface portion 332 that extends from the second corner portion 22 to the spout opening 335 may function as a surface portion that inhibits ink received by the receiving surface portion 310 from leaking to the outside of the case 2.

In the present embodiment, a direction (hereinafter referred to as a first direction) that is orthogonal to the extending direction of the line L and to also the direction of the axial line X is the left-right direction of the case 2. A direction (hereinafter referred to as a second direction) that is orthogonal to the first direction and also to the direction of the axial line X is the up-down direction of the case 2. As shown in FIG. 5, the width (the distance from the left side surface to the right side surface) in the left-right direction of the case 2 is smaller than a width (a distance from the bottom surface to the top surface, or a height of the left wall 30 and the lid portion 4) in the up-down direction of the case 2. Further, the ink pack 7 is housed in the case 2 such that, in the second direction, the axial line X is located closer to one end portion of the case 2 on the side including the second corner portion 22. In the present embodiment, the second direction is the up-down direction of the case 2, as described above. Accordingly, in the up-down direction, the one end portion of the case 2 on the side including the second corner portion 22 is an end portion on the bottom wall 31 side. Therefore, as shown in FIG. 13, the axial line X is located closer to the end portion on the bottom wall 31 side in the up-down direction of the case 2.

As shown in FIG. 14, the spout opening 335 is provided in the inclined surface portion 332, at a position that faces the second opening 702 of the spout 72. In other words, the spout opening 335 is located on the axial line X of the spout 72. As described above, the second opening 702 is closed by the rubber plug 723. Therefore, actually, the spout opening 335 faces the rubber plug 723.

Figure 15:
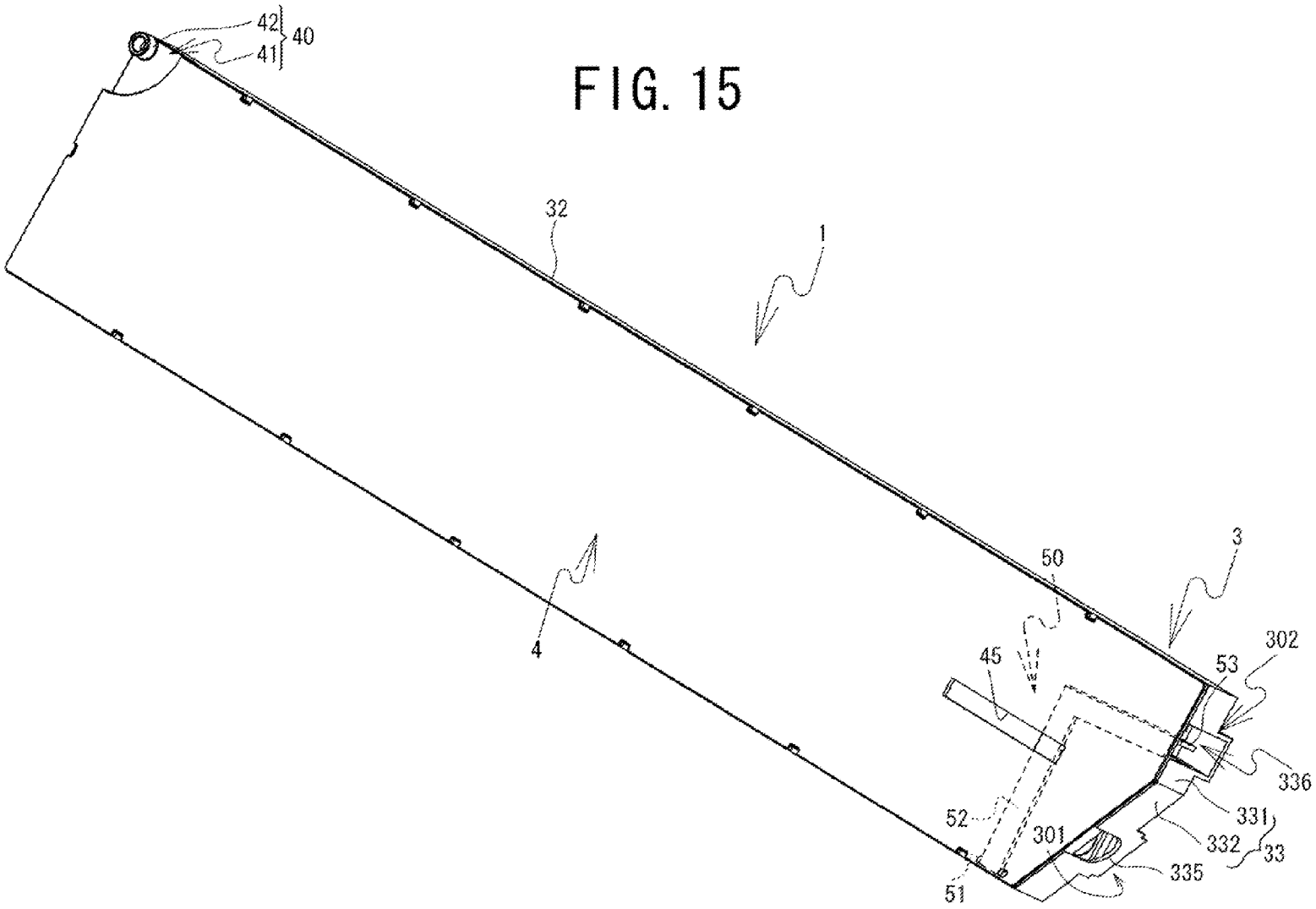
FIG. 15 is an explanatory diagram of a movable member 50.
Figure 16:
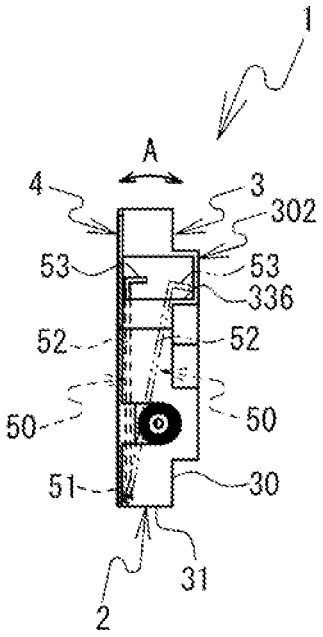
FIG. 16 is an explanatory diagram of movements of the movable member 50.

The movable member 50, which is an internal component disposed inside the case 2 other than the ink pack 7, will be explained below. As shown in FIG. 15 and FIG. 16, the movable member 50 includes a shaft portion 51, the arm portion 52 and the exposed portion 53. The arm portion 52 is as L-shaped plate member. One end (base end) of the arm portion 52 is connected to the shaft portion 51. The shaft portion 51 is fixed to the case 2 along the front-rear direction, in the vicinity of the rear end portion of the bottom wall 31 and in the vicinity of the end portion on the lid portion 4 side. The arm portion 52 is supported by the shaft portion 51 such that a plate surface of the arm portion 52 faces the left wall 30 and the lid portion 4, and the arm portion 52 can pivot in the left-right direction (in the directions of an arrow A in FIG. 16). A torsion spring is mounted on the shaft portion 51 and the arm portion 52 is thus urged in the direction of the left wall 30 (to the right in FIG. 16). The exposed portion 53 is a square plate member that has sides each having a length that is shorter than the length of the second rear leg portion 302 in the front-rear direction. The exposed portion 53 is connected to the upper end of the leading end portion of the arm portion 52 such that a plate surface of the exposed portion 53 is substantially perpendicular to the plate surface of the arm portion 52 and extends toward the left wall 30. As shown in FIG. 16, the exposed portion 53 is positioned such that it can be seen through the first exposure opening 336.

When the cartridge 1 is initially used, the ink storage portion 717 of the ink bag 71 (refer to FIG. 13) is fully filled with ink, and thus, as shown in FIG. 12, the ink bag 71 is in a distended state. Thus, the left side face (the right side face in FIG. 16) of the arm portion 52 of the movable member 50 is pressed by the ink bag 71, and the arm portion 52 thus resists the urging force of the spring and may pivot around the shaft portion 51 in the direction toward the lid portion 4, as far as a position on the left side shown in FIG. 16. On the other hand, when the amount of remaining ink reduces, the ink bag 71 contracts, and accordingly, the pressure on the arm portion 52 becomes weaker. As a result, due to the urging force of the spring, the arm portion 52 pivots in the direction toward the left wall 30. When there is no ink remaining, the exposed portion 53 may reach a position on the right side shown in FIG. 16. Accordingly, the position of the exposed portion 53 may change in accordance with the amount of remaining ink. In the ink cartridge 1, by providing the second rear end leg portion 302 on the left wall 30 so as to be continuous with the first exposure opening 336, the space in which the exposed portion 53 can move may be secured. The user can verify the position of the exposed portion 53 of the movable member 50 through the first exposure opening 336, and can thus verify the amount of remaining ink stored in the ink bag 71. In this way, the movable member 50 may function as a remaining ink amount indicator member.

Figure 17:
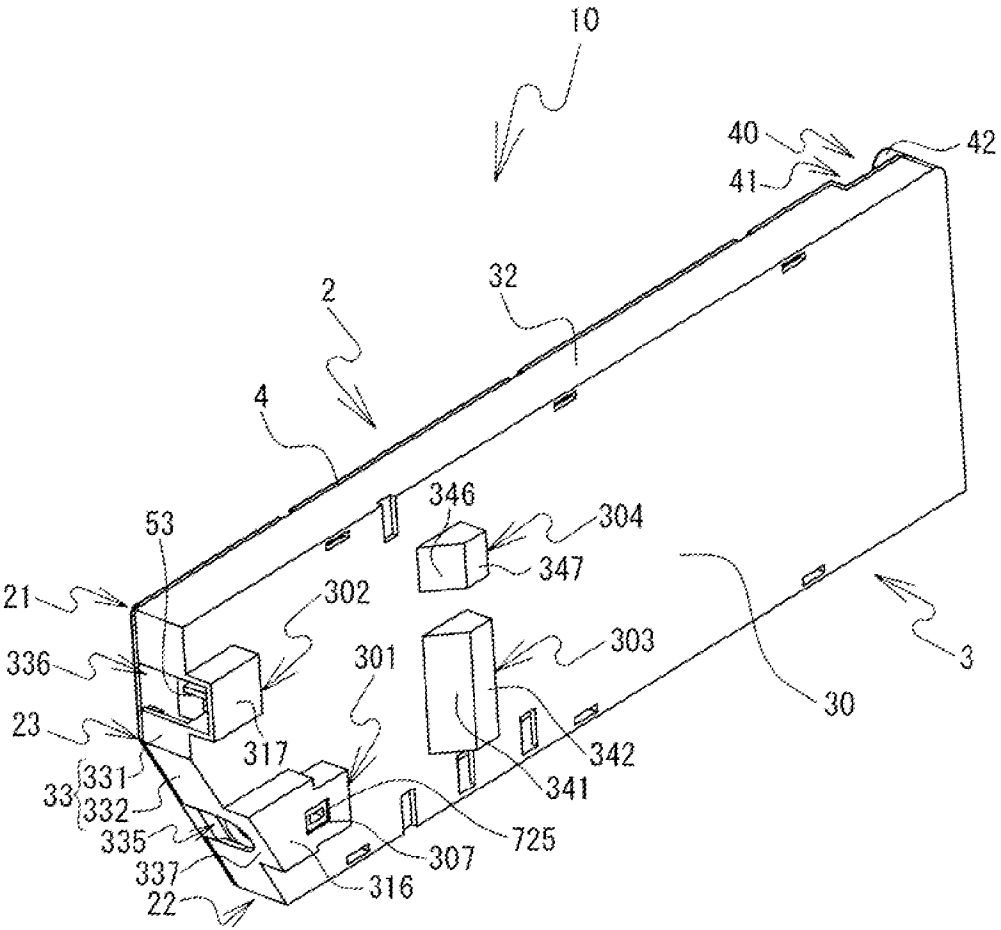
FIG. 17 is a perspective view of an ink cartridge 10 as viewed from the rear left.
Figure 18:
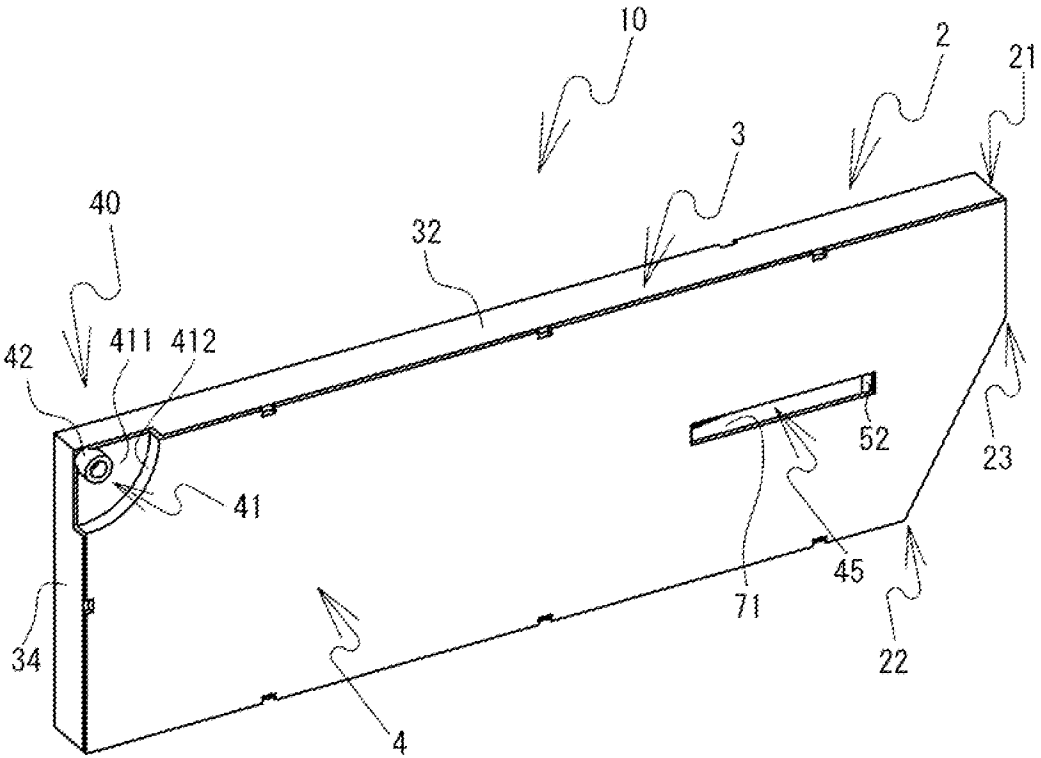
FIG. 18 is a perspective view of the ink cartridge 10 as viewed from the front right.

A cartridge 10 having a different shape to the cartridge 1 shown in FIG. 1 to FIG. 16 will be explained below with reference to FIG. 17 and FIG. 18. The cartridge 10 is configured such that the longitudinal length (the length in the front-rear direction) of the case 2 is shorter than in the cartridge 1. The length of the cartridge 10 is roughly half the length of the cartridge 1. Meanwhile, the width (the length in the left-right direction) and the height (the length in the up-down direction) are substantially the same as those of the cartridge 1. Thus, the amount of ink that is internally housed is also roughly half in comparison to that of the cartridge 1.

In contrast to the cartridge 1, in the cartridge 10, the front end leg portion 305 is not provided in the left wall 30, in the vicinity of the front wall 34. This is because, with the case 2 having a long length such as that in the cartridge 1, in terms of dimensional balance, it may be difficult for the leg portions 301 to 304 to support the whole of the cartridge 1 in a state in which the whole of the left wall 30 is separated from a placement surface. In contrast, in the cartridge 10, there is a greater possibility that only the leg portions 301 to 304 can support the whole of the cartridge in such a state. Apart from this point described above, the structure of the cartridge 10 is basically the same as that of the cartridge 1. Both the cartridge 1 and the cartridge 10 can be mounted in the printer 100 (refer to FIG. 1).

Mounting of the cartridges 1 and 10 in the printer 100 will be explained below with reference to FIG. 1 and FIG. 19. As shown in FIG. 1, when mounting the cartridge 1 in the printer 100, the user inserts the cartridge 1 into one of the cartridge insertion ports 120 of the printer 100. At this time, the user may insert the cartridge 1 from the side of the rear wall 33, in which the spout opening 335 (refer to FIG. 2) that faces the second opening 702 (the rubber plug 723) is provided, with the bottom wall 31 of the cartridge 1 being on the lower side. When the user pushes the cartridge 1 in, the cartridge 1 may be guided toward the rear inner side (to the rear) of the printer 100 along the cartridge mounting portion 108 that is the passage provided in the printer 100. As described above, the width and the height of the cartridge mounting portion 108 are slightly larger than the width and the height of the cartridge 1. Thus, the cartridge 1 may be guided in a stable posture while the bottom wall 31 may slide over a placement surface 130 (refer to FIG. 19) of the cartridge mounting portion 108. The placement surface 130 is a flat surface that extends in a substantially horizontal direction.

Figure 19:
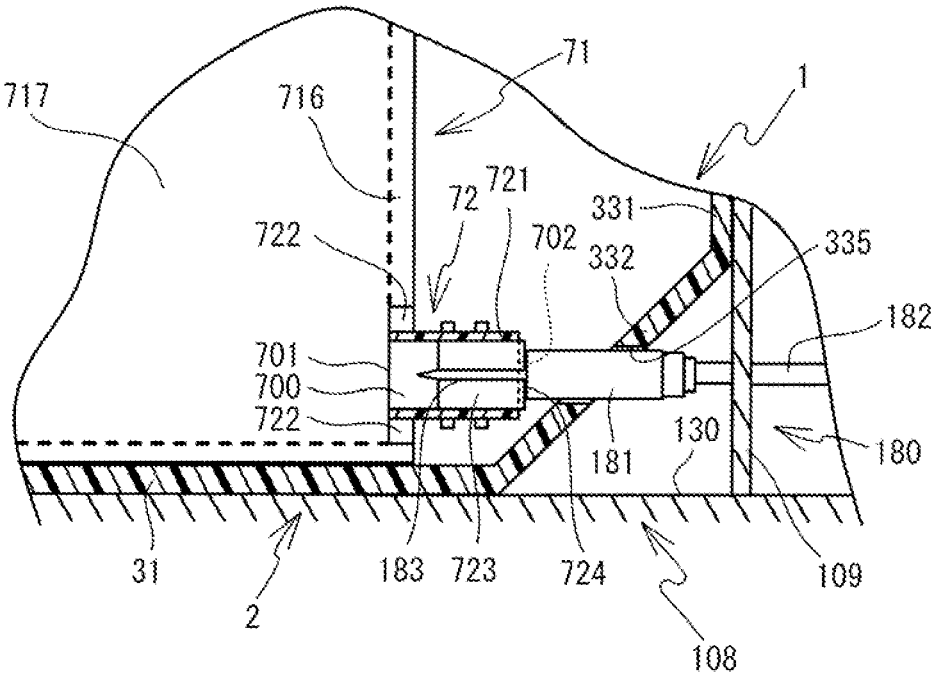
FIG. 19 is an enlarged partial cross-sectional view of the spout 72 and its surrounding area of the ink cartridge 10 when ink is being supplied.

As shown in FIG. 19, a contact plate 109 is provided at the rear end portion (the end portion on the rear inner side) of the cartridge mounting portion 108. The contact plate 109 extends upward, substantially perpendicularly from the placement surface 130. The contact plate 109 may come into contact with the back surface portion 331 of the cartridge 1, and thus inhibit the cartridge 1 from moving any further to the rear. Note that, as described above, the cartridge mounting portion 108 has a length that is roughly one third the length of the cartridge 1 in the front-rear direction. Thus, the back surface portion 331 comes into contact with the contact plate 109 when roughly one third of the cartridge 1, on the rear end side, is inserted into the cartridge mounting portion 108. This state is a state in which mounting of the cartridge 1 into the cartridge mounting portion 108 has been completed. Note that, in the case of the cartridge 10 (refer to FIG. 17) that is shorter than the cartridge 1, the back surface portion 331 comes into contact with the contact plate 109 when roughly two thirds of the rear end side of the cartridge 10 is inserted into the cartridge mounting portion 108.

In addition, a connection portion 180 is provided in the rear end portion of the cartridge mounting portion 108. The connection portion 180 includes a fixing portion 181, a tube 182 that is connected to the fixing portion 181, and a suction needle 183 that is adapted to draw out the ink. Note that, in actuality, the fixing portion 181 may be fixed inside the cartridge mounting portion 108, but this fixed portion is omitted from the drawings. The fixing portion 181 is disposed in a position that faces the spout opening 335 provided in the inclined surface portion 332 when the cartridge 1 is placed on the placement surface 130. The tube 182 may lead the ink drawn out from the ink bag 71 to the print head 114. The suction needle 183 protrudes from the fixing portion 181 on the side opposite to the side on which the tube 182 is connected.

As the cartridge 1 is pushed toward the contact plate 109, a part of the fixing portion 181 that has the suction needle 183 may be inserted into the interior of the case 2, through the spout opening 335. Then, the suction needle 183 may pierce a central portion of the rubber plug 723 and the connection portion 180 may be thus connected to the cartridge 1. When mounting of the cartridge 1 in the cartridge mounting portion 108 has been completed, the suction needle 183 may penetrate the rubber plug 723 and a leading end portion of the suction needle 183 may be disposed inside the hollow portion 700. The leading end portion of the suction needle 183 is provided with a hole through which ink may flow. The ink in the ink storage portion 717 can be supplied to the print head 114 via the first opening 701, the inside of the hollow portion 700, the suction needle 183 and the tube 182.

Figure 20:
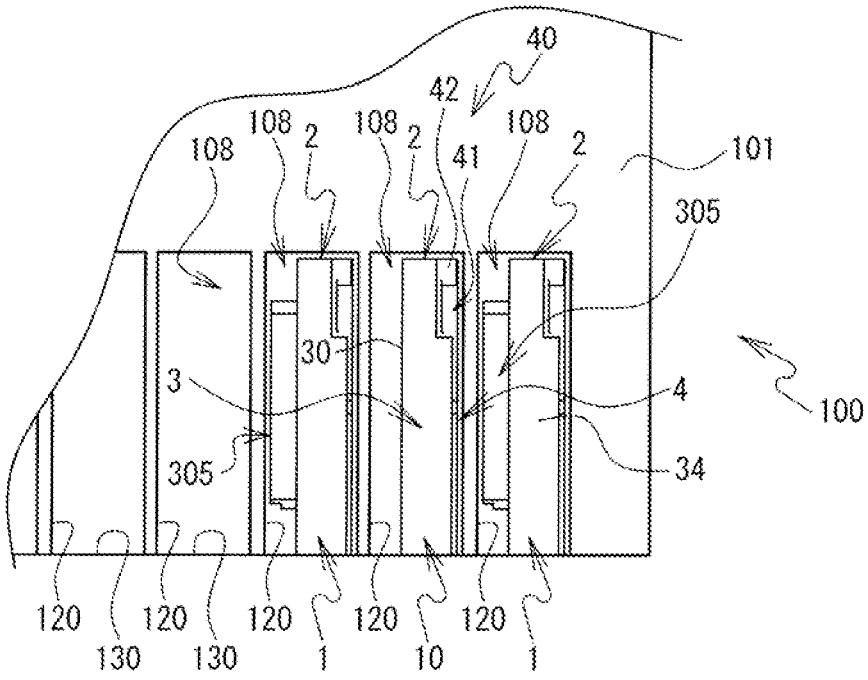
FIG. 20 is an explanatory diagram showing the ink cartridges 1 and the ink cartridge 10 mounted in the printer 100, as viewed from the front.
Figure 21:
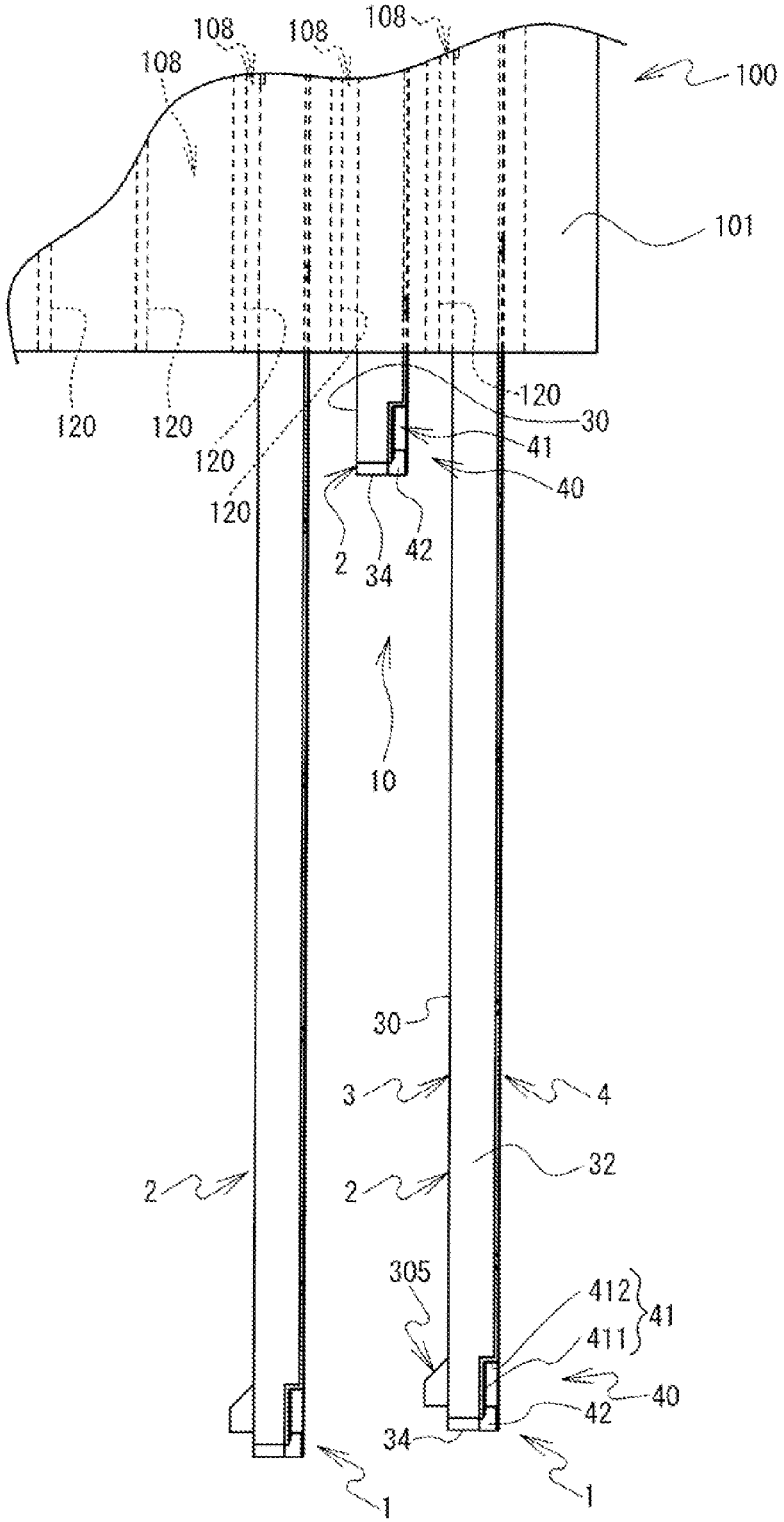
FIG. 21 is an explanatory diagram showing the ink cartridges 1 and the ink cartridge 10 mounted in the printer 100, as viewed from above.

Operations and effects of the handle portion 40 when the cartridge 1 or 10 is removed from the printer 100 will be explained below. The cartridge 1 or the cartridge 10 can be mounted in each of the eight cartridge mounting portions 108 of the printer 100 by the method described above. FIG. 20 and FIG. 21 show an example in which the cartridge 1, the cartridge 10 and the cartridge 1 are mounted in that order from the right, into three of the cartridge mounting portions 108 from the right end of the printer 100 shown in FIG. 1. When a plurality of the cartridges 1 and 10 are mounted into the printer 100 in this way, there is only a slight gap between the neighboring cartridges 1 and 10. In particular, the front end leg portion 305 that protrudes to the left is provided in the left wall 30 of the cartridge 1 in the vicinity of the front end portion, and thus, when there is the neighboring cartridge 1 or the cartridge 10 on the left side, the gap between the front end leg portion 305 and the lid portion 4 of the adjacent cartridge 1 or 10 becomes even narrower.

When the user wishes to remove the cartridge 1 or 10 from the printer 100, the user may need to insert his/her fingers into the slight gaps, grip the cartridge 1 or 10, and pull it out. In the present embodiment, the cartridges 1 and 10 are provided with the handle portion 40 that is formed of the recessed portion 41 and the protruding portion 42, on the upper right corner portion of the front end portion of the case 2. As described above, the recessed portion 41 is open in three directions, namely, to the right, to the front and to the upper side of the case 2. In these three directions, compared to a case in which the recessed portion 41 is not provided, a space into which the user can insert his/her fingers is increased. Further, the user can insert his/her fingers from any one of the three directions, or from two or three of the directions. In addition, the peripheral wall portion 412 of the recessed portion 41, which is provided along the arc-shaped edge of the bottom portion 411, is a wall portion whose inner side surface is a curved surface. Thus, the fingers may be guided along the curved surface and can therefore be easily inserted into the recessed portion 41.

As the bottom portion 411 of the recessed portion 41 is a flat portion, the user can hold the bottom portion 411 and the outer surface of the left wall 30 that faces the bottom portion 411 between his/her fingers, and can easily grip the case 2. Furthermore, the protruding portion 42 protrudes from the bottom portion 411 of the recessed portion 41 toward the right, and thus, after inserting his/her fingers into the recessed portion 41, the user can hook his/her fingers around the protruding portion 42 or can hold the protruding portion 42 between his/her fingers. As the protruding portion 42 has a hollow cylindrical shape, the outer peripheral surface that the fingers touch is a curved surface. Thus, the user can smoothly hook his/her finger around the protruding portion 42. Further, there may be no pain caused to the finger.

For example, when the user wishes to remove the short cartridge 10 that is in the center as shown in FIG. 20 and FIG. 21, the user can perform the following type of operation. When the user can insert his/her hand into the gap between the cartridge 1 on the right side and the cartridge 1 on the left side, the user may insert his hand from the front, insert his/her index finger into the recessed portion 41 from above and hook it around the protruding portion 42, then place his/her thumb on the left side surface of the case 2 (the outer surface of the left wall 30). Then, the user may touch the surface portion of the bottom portion 411 of the recessed portion 41 with the side of his/her index finger, grip the case 2 from the left and the right using his/her thumb and index finger, and pull out the cartridge 10 toward the front. In addition, the user may pull out the cartridge 10 when the index finger can be inserted into the recessed portion 41 from above or from below and can be hooked around the protruding portion 42, or when the protruding portion 42 can be gripped by the index finger and the thumb. Even when the hand cannot be inserted into the gap between the cartridge 1 on the left side and the cartridge 1 on the right side, the index finger can be inserted into the recessed portion 41 from above the cartridge 10 and hooked around the protruding portion 42 and the cartridge 10 can be pulled out toward the front. Even in the case of the long cartridge 1, the cartridge 1 can be removed by a similar operational method.

In this way, even when the plurality of cartridges 1 and 10 are mounted in the printer 100 with only slight gaps between them, by using the handle portion 40, the user can easily pull out and remove the selected cartridge 1 or 10 from among the plurality of cartridges 1 and 10. Further, even when the cartridges 1 and 10 are arranged side by side without any gaps, or with only slight gaps between them, by a similar method to that described above, the user can remove the desired cartridge 1 or cartridge 10. When mounted in the printer 100, basically, the cartridge 1, 10 may be pulled out toward the front. On the other hand, for example, when the plurality of cartridges 1 and 10 are not mounted in the printer 100 and are arranged side by side with the bottom wall 31 on the lower side, the user may also pull up the cartridge 1, 10 in the upward direction and remove the cartridge 1, 10. As described above, the recessed portion 41 is open in the upward direction of the cartridge 1, 10 and thus, even in this type of case, the cartridge 1, 10 can be easily removed.

Note that, as in the present embodiment, by providing the handle portion 40 on the corner portion of the case 2, a finger can more easily be inserted into the recessed portion 41 than when the handle portion 40 is provided on a center portion of the end portion of the case 2. Further, the handle portion 40 is provided on the front end portion, which is on the opposite side of the rear end portion that is on the side to be connected to the connection portion 180 on the rear inner side of the cartridge mounting portion 108. Thus, the cartridge 1 can be easily removed from the printer 100. In addition, the spout 72 is disposed in the rear end portion of the cartridge 1. Sometimes, the ink may leak and adhere around the leading end portion 724 of the spout 72. However, by providing the handle portion 40 on the front end side, even if the ink adheres around the spout 72, it is possible to reduce a possibility that the ink adheres to and stains the fingers of the user who is handling the handle portion 40. Furthermore, the spout opening 335 and the first exposure opening 336 are provided in the rear end portion of the cartridge 1. However, as the handle portion 40 is provided on the front end side, this can reduce a possibility that the user mistakenly inserts his/her fingers into these openings when handling the handle portion 40.

A method for collecting the ink when the amount of remaining ink in the ink bag 71 is decreased will be explained below, taking the cartridge 1 as an example. Note that, also in a case of the cartridge 10, which is shorter than the cartridge 1, the method for collecting the ink and the obtained effects may be similar to those of the cartridge 1. When the cartridge 1 is initially used, the ink bag 71 is fully filled with ink. Accordingly, the inner surfaces of the two layers of sheets that form the ink bag 71 are separated from each other, as shown in FIG. 12, with the ink interposed between the inner surfaces.

When the cartridge 1 is mounted in the cartridge mounting portion 108, as shown in FIG. 19, and printing is performed, the ink is discharged from the print head 114 (refer to FIG. 1) little by little in order to form an image on the fabric. When the ink is discharged, a substantially same amount of ink as a discharge amount is sucked from the cartridge 1, and is replenished to the print head 114. Thus the ink stored in the ink storage portion 717 gradually reduces as the ink is consumed by printing, and the ink bag 71 contracts. As a result, the inner surfaces of the two layers of flexible sheets may come closer to each other.

When the amount of remaining ink reduces to a certain extent, the inner surfaces of the sheets may come into contact with each other, here and there, in the ink bag 71. As a result, the ink may be divided by portions where the inner surfaces of the sheets come into contact with each other, influenced by a surface tension of the ink and a gravitational force, for example. In this case, a plurality of ink deposits may be formed that are isolated in the ink storage portion 717 (refer to FIG. 19). Further, in a state in which the bottom wall 31 is placed on the substantially horizontal placement surface 130, as shown in FIG. 19, the two layers of sheets of the ink bag 71 are disposed such that their surfaces extend substantially in the up-down direction. Therefore, due to the gravitational force, part of the ink may flow downward along the inner surfaces of the sheets and may be accumulated along the end portion on the bottom wall 31 side inside the ink storage portion 717. However, as the ink reduces, the ink surface (the top surface of the liquid ink) may become lower than the hole in the leading end portion of the suction needle 183. In this case, even when the ink still remains in the ink storage portion 717, it may become difficult for the print head 114 to suck the remaining ink because a suction force of the print head 114 is weak.

Figure 22:
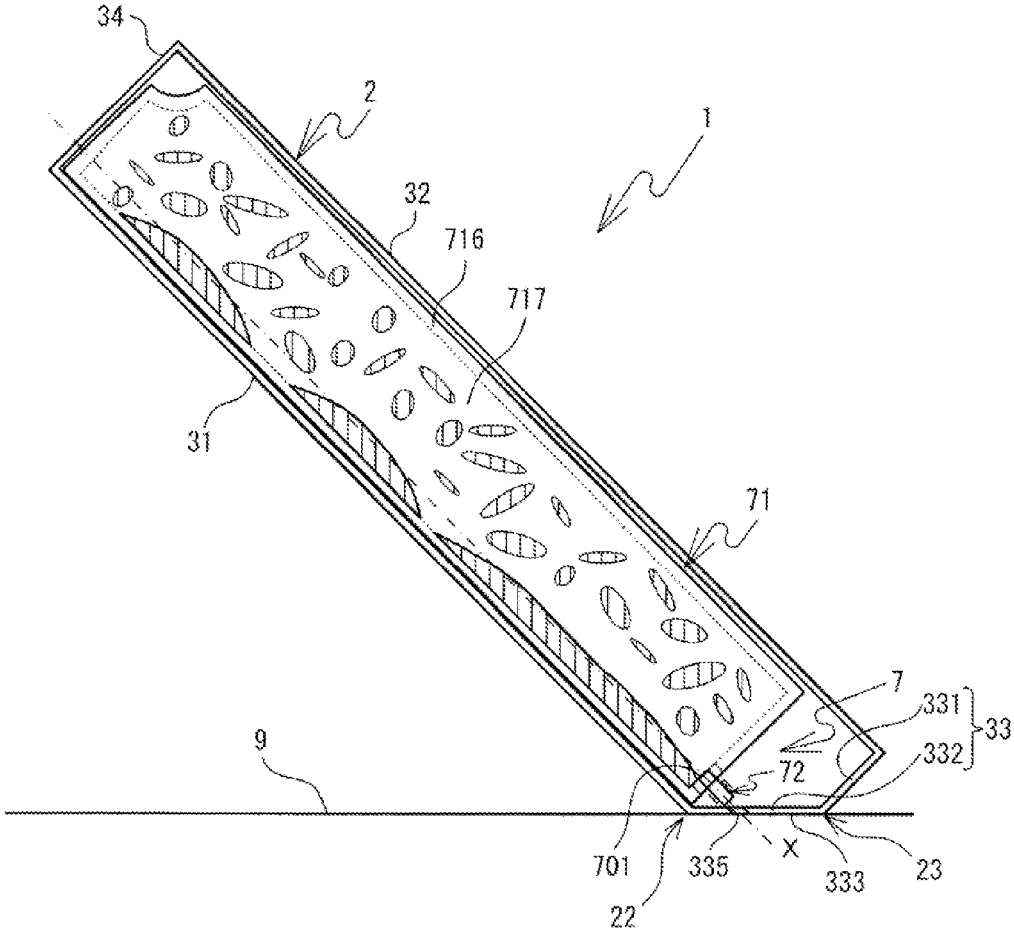
FIG. 22 is an explanatory diagram showing a process of collecting ink by tilting the ink cartridge 1.

Even when it is difficult to suck the ink in this manner, owing to the structure in which the rear end portion is formed of the back surface portion 331 and the inclined surface portion 332, the cartridge 1 of the present embodiment can be removed from the printer 100 and the ink remaining in the ink storage portion 717 may be effectively collected toward the spout 72, more specifically, toward the first opening 701. This operational effect will be explained below with reference to FIG. 19, FIG. 22 and FIG. 23. As shown in FIG. 22, the user may place the cartridge 1, in which the remaining ink amount is reduced and part of the ink is accumulated along the end portion of the ink bag 71 on the bottom wall 31 side, such that the inclined surface portion 332 is on the lower side and such that the second corner portion 22 and the third corner portion 23, specifically, the outer surface 333 of the inclined surface portion 332, is supported by a support surface 9 that is a substantially horizontal surface. In this case, the direction of the axial line X that substantially matches the longitudinal direction of the ink storage portion 717 is closer to upright than when the ink is supplied in the printer 100. Note that the support surface 9 may be a flat surface, such as a desk top surface, or may not be a flat surface. The leading end portion 724 on the second opening 702 (refer to FIG. 19) side of the spout 72 is located on the inner side of the case 2 with respect to the outer surface 333. Therefore, when the inclined surface portion 332 comes into contact with the support surface 9, there is no interference between the spout 72 and the support surface 9.

Thus, the cartridge 1 enters a state in which the longitudinal direction (the axial line X of the spout 72) of the case 2 and the ink bag 71 is inclined with respect to the horizontal direction, and the second opening 702 of the spout 72 is directed obliquely downward. The end portion of the ink bag 71 on the bottom wall 31 side is also inclined with respect to the horizontal direction. In a similar manner to when the bottom wall 31 is placed on the substantially horizontal placement surface 130, the two layers of sheets that form the ink storage portion 717 are disposed such that their surfaces extend substantially in the up-down direction. Part of the ink may move in the ink storage portion 717 due to a force that is applied when the posture of the cartridge 1 is changed. In a state in which the axial line X of the spout 72 is substantially horizontal (refer to FIG. 19) before the posture of the cartridge 1 is changed, the ink dispersed in the ink storage portion 717 may not move because the inner surfaces of the sheets are in contact with each other. At this time, the direction of the gravitational force applied to the dispersed ink is substantially perpendicular to the axial line X of the spout 72. On the other hand, when the posture of the cartridge 1 is changed as shown in FIG. 22, the direction of the gravitational force applied to the dispersed ink changes to an oblique direction with respect to the axial line X of the spout 72.

After the posture of the cartridge 1 is changed in this manner, the user may continue to hold the cartridge 1 in an inclined state for a while. In this case, the ink in the ink storage portion 717 may start to move downward along the inner surfaces of the sheets due to the gravitational force and the movement of the ink along with the above-described change in posture. As described above, the surfaces of the sheets extend substantially in the up-down direction, and thus the ink may move smoothly downward. The ink accumulated along the end portion on the bottom wall 31 side inside the ink storage portion 717 may flow toward the corner portion (in the vicinity of which the spout 72 is provided) along the end portion on the bottom wall 31 side, because the end portion on the bottom wall 31 side is inclined with respect to the horizontal direction. Some of the isolated ink deposits may start to move downward due to the gravitational force. A part of the ink deposits may join with another ink deposit in the middle of downward movement to thereby form a larger ink deposit, and the larger ink deposit may move downward and flow toward the spout 72 along the end portion on the bottom wall 31 side.

The second corner portion 22 forms an obtuse angle. In the case 2, the axial line X of the spout 72 is located closer to the end portion on the bottom wall 31 side having the second corner portion 22. Therefore, when the cartridge 1 is inclined such that the second corner portion 22 and the third corner portion 23 are positioned on the lower side and the inclined surface portion 332 is positioned substantially horizontally, the spout 72 is disposed in a position that is closer to the support surface 9. As a result, the ink may easily collect in the vicinity of the first opening 701 of the spout 72. Further, the axial line X is located closer to one end portion (the end portion on the bottom wall 31 side) of the ink bag 71 that is positioned in the direction that is orthogonal to the axial line X. Taking the axial line X as a boundary, the width of the ink bag 71 from the axial line X to the end portion on the bottom wall 31 side is smaller than the width of the ink bag 71 from the axial line X to the opposite side. Therefore, when the cartridge 1 is inclined such that the inclined surface portion 332 is substantially horizontal, the ink may easily collect in the vicinity of the first opening 701 of the spout 72.

Figure 23:
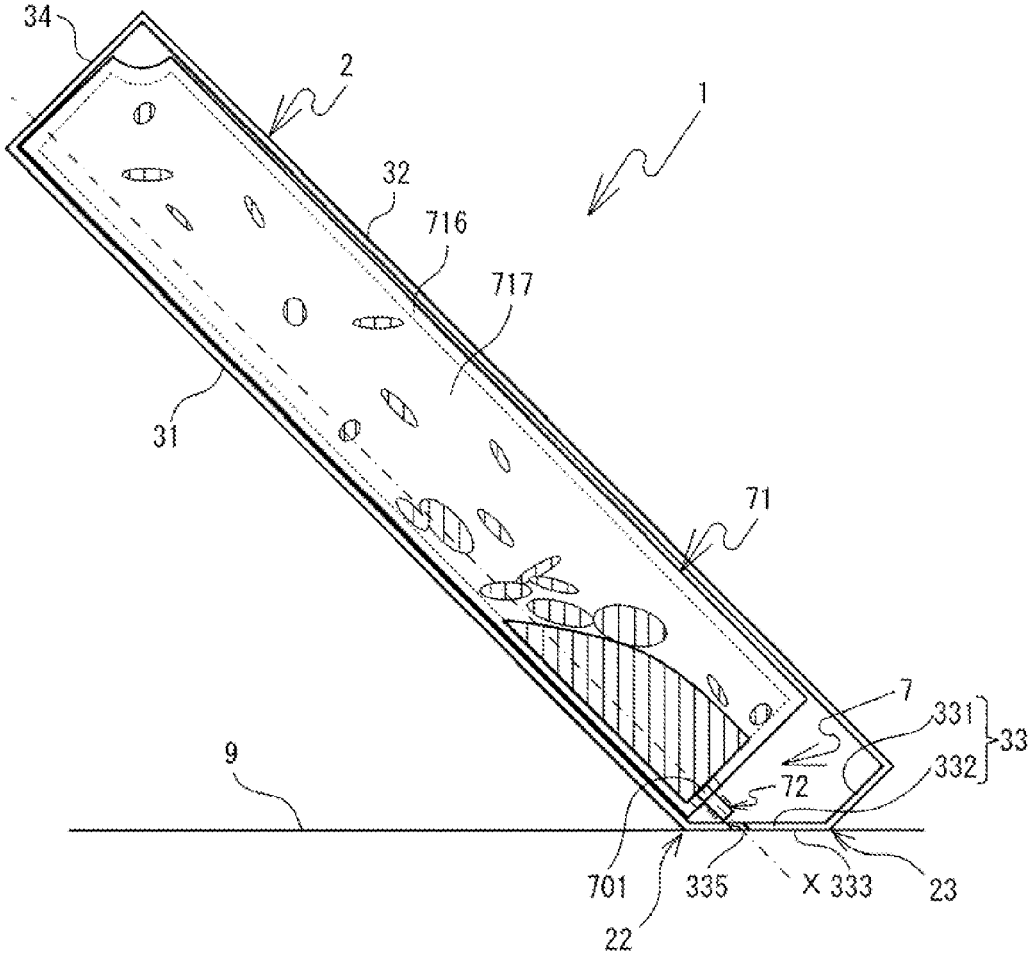
FIG. 23 is another explanatory diagram showing the process of collecting the ink by tilting the ink cartridge 1.

Further, when the cartridge 1 continues to be inclined, as shown in FIG. 23, most of the ink that remained in the form of ink deposits here and there inside the ink storage portion 717 may gather in the vicinity of the first opening 701 of the spout 72. In this state, most of the inner surfaces of the sheets may be in contact with each other in the end portion on the front wall 34 side of the ink bag 71 and the vicinity of the end portion on the front wall 34 side. In the longitudinal direction of the ink bag 71, the end portion on the front wall 34 side is located on the side opposite to the side where the spout 72 is provided.

In the state in which the ink has been collected around the first opening 701 in this manner, the user may set the cartridge 1 in the printer 100 again, with the bottom wall 31 being on the lower side, as shown in FIG. 19. As shown in FIG. 23, more ink has been collected around the first opening 701 as compared to the state shown in FIG. 22. In addition, in the end portion of the ink bag 71 on the front wall 34 side and the vicinity of the end portion on the front wall 34 side, most of the inner surfaces of the two sheets may be in contact with each other. Therefore, even when the bottom wall 31 is placed on the placement surface 130 and the end portion of the ink bag 71 on the bottom wall 31 side is positioned substantially horizontally, the movement of the ink from the vicinity of the first opening 701 toward the end portion on the bottom wall 31 side may be inhibited to some extent. As a result, it is possible to maintain a state in which the ink surface is above the hole of the leading end portion of the suction needle 183 that is pierced through the rubber plug 723. Thus, the remaining ink can be supplied to the print head 114.

As explained above, in the case 2, the handle portion 40 (refer to FIG. 3) is provided in the upper right corner portion of the front end portion of the case 2 that is located diagonally opposite to the second corner portion 22, in the vicinity of which is provided the spout 72. As a result, the user can insert his/her fingers into the recessed portion 41 of the handle portion 40 and can grip the protruding portion 42, and can thus easily maintain the cartridge 1 in the inclined state and collect the ink toward the spout 72.

Further, the front end leg portion 305 (refer to FIG. 2) is provided in the left wall 30 of the case 2, in the vicinity of the front end portion that is on the opposite side to the rear end portion, in the vicinity of which is provided the spout 72. Thus, the user can grip the front end leg portion 305 and easily maintain the cartridge 1 in the inclined state and collect the ink toward the spout 72.

As described above, the case 2 is made of plastic, and the body portion 3 and the lid portion 4 may be respectively manufactured by injection molding using dies. Normally, in the injection molding of plastic, when the peripheral walls 31 to 34 are provided substantially vertically (also including draft angles) from the left wall 30, as in the body portion 3, if a slider is used that moves in a perpendicular direction with respect to the peripheral walls 31 to 34, structures of the dies may become complex and manufacturing costs may increase. Thus, if the body portion 3 can be manufactured using only simple dies that move in a perpendicular direction with respect to the left wall 30, this is preferable, as it can be easily manufactured at low cost. In the present embodiment, as described above, the leg portions 301 to 305 are the recessed portions formed by indenting the left wall 30 from the inner surface side to the outer surface side, and the spout opening 335 and the first exposure opening 336 are the recessed portions that extend toward the left wall 30 from the end portion of the rear wall 33 that is on the opposite side to the end portion that connects to the left wall 30. Thus, the body portion 3 can be easily manufactured by integral molding, using the simple dies that move in the perpendicular direction with respect to the left wall 30. Further, by providing the leg portions 301 to 305 as the recessed portions formed by indenting the left wall 30 from the inner surface side to the outer surface side, the strength of the left wall 30 may be increased in comparison to a case in which the left wall 30 is a flat plate-shaped wall portion.

The spout opening 335 and the first exposure opening 336 are provided, respectively, in the inclined surface portion 332 and the back surface portion 331 of the rear wall 33. The inclined surface portion 332 and the back surface portion 331 form the third corner portion 23, whose outer surfaces form an obtuse angle. As a result, even when the spout opening 335 and the first exposure opening 336 are formed in the inclined surface portion 332 and the back surface portion 331, the strength of the rear wall 33 as a whole may be favorably maintained. In addition, the first rear end leg portion 301 and the second rear end leg portion 302, which are the recessed portions formed by indenting the left wall 30 from the inner surface side to the outer surface side, are provided in the left wall 30 in positions that respectively correspond to the spout opening 335 and the first exposure opening 336. As a result, the strength around these openings may be maintained in an even more favorable manner. Note also that, as for the spout opening 335, the connecting wall portion 337, which is provided between the end of the spout opening 335 on the left wall 30 side and the connecting portion of the inclined surface portion 332 and the bottom wall section of the recessed portion that is the first rear end leg portion 301, may contribute, along with the first rear end leg portion 301, to improving the strength of the rear wall 33.

As described above, the leg portions 301 to 304 may have at least two functions. In this way, it may not be necessary to provide individual structural members to fulfill different functions, and manufacturing can be performed easily by injection molding. For example, by forming the first intermediate leg portion 303 and the second intermediate leg portion 304 integrally with the left wall 30, there may be no need to affix a sticker indicating the ink color to the case 2 after assembling the body portion 3 and the lid portion 4. In addition, at a time of assembly, an operator can visually check the positions of the first intermediate leg portion 303 and the second intermediate leg portion 304 that are provided on the body portion 3, and can thus easily determine whether to fix the ink pack 7 with the white ink in the body portion 3 or whether to fix the ink pack 7 with the ink other than the white ink in the body portion 3.

Further, although the handle portion 40 is provided on the lid portion 4, both the peripheral wall portion 412 and the protruding portion 42 that form the handle portion 40 are the wall portion and the shaft portion that are provided substantially perpendicularly to the lid portion 4. Thus, similarly to the body portion 3, the lid portion 4 can also be manufactured by dies with simple structures in which only dies that move perpendicularly with respect to the lid portion 4. Note that, by forming the protruding portion 42 in a hollow cylindrical shape, it is possible to form the protruding portion 42 that has a greater strength with less material, in comparison to a case in which a cylindrical shape is formed with a filled center. Furthermore, as it is possible to make the thickness of the walls of the case 2 and of the protruding portion 42 roughly uniform, the plastic molding may become easier. In addition, in the present embodiment, there is also a wall that forms the bottom portion 411 in a section that corresponds to the central hollow portion of the protruding portion 42. As a result, it is possible to increase the strength of the protruding portion 42, in comparison to a case in which there is no wall and an opening that penetrates the lid portion 4 is formed in this section.

The present invention is not limited to the above-described embodiment, and various modifications are possible. Some examples of changes added to the above-described embodiment will be explained below.

For example, in the above-described embodiment, an example is described in which the leg portions 301 to 305 (refer to FIG. 2) are provided on the longer cartridge 1, but some or all of the leg portions 303 to 305 may be omitted. When only the first rear end leg portion 301 and the second rear end leg portion 302 are provided in the cartridge 1 as the leg portions that protrude from the left wall 30, when the cartridge 1 is placed on the flat surface with the left wall 30 on the lower side and the lid portion 4 on the upper side, the rear end portion side of the left wall 30 on which the first rear end leg portion 301 and the second rear end leg portion 302 are provided can be separated from the flat surface and a gap can be formed underneath. On the other hand, the front end portion of the left wall 30 comes into contact with the flat surface and the left wall 30 is held stably in an inclined state. The first rear end leg portion 301 and the second rear end leg portion 302 are separated from each other, and further, both the first rear end leg portion 301 and the second rear end leg portion 302 are separated from the upper end portion and the lower end portion. Thus, a gap can be reliably formed between the left wall 30 and the flat surface both between and around the first rear end leg portion 301 and the second rear end leg portion 302. As a result, the user can insert his/her fingers into the gap between the first rear end leg portion 301 and the second rear end leg portion 302, or from the upper end portion or the lower end portion, and can easily pick up the cartridge 1.

When the cartridge 1 is placed on the flat surface with the left wall 30 on the upper side, the user can grip at least one of the first rear end leg portion 301 and the second rear end leg portion 302 or can hook his/her finger around them and move the cartridge 1. Thus, the degree of freedom in handling the cartridge 1 may be improved. Even when only the first rear end leg portion 301 and the second rear end leg portion 302 are provided in this way, the user can easily pick up the cartridge 1 placed on top of the flat surface.

Note that when a leg portion apart from the first rear end leg portion 301 and the second rear end leg portion 302 is provided, the cartridge 1 can be supported in an even more stable posture if the leg portion is provided within a range, in the up-down direction of the left wall 30, in which the first rear end leg portion 301 and the second rear end leg portion 302 are arranged (namely, within a range from the lower edge of the first rear end leg portion 301 to the upper edge of the second rear end leg portion 302).

In addition, the leg portions 301 to 305 may be provided in the left wall 30 in different positions and having different shapes to those of the above-described embodiment. For example, in a cartridge 11 shown in FIG. 24, the second intermediate leg portion 304 and the front end leg portion 305 are omitted. Note that, with the cartridge 11 also, the first intermediate leg portion 303 is the leg portion that may function as the color indicator portion. The first intermediate leg portion 303 is provided in a range that does not extend into the determination area R (refer to FIG. 6) and indicates that the ink color is white.

In the cartridge 11, an upper end leg portion 307 and a lower end leg portion 308 are provided in place of the second intermediate leg portion 304 and the front end leg portion 305. The upper end leg portion 307 is a thin plate that protrudes from the left wall 30 toward the left along the top wall 32. The lower end leg portion 308 is a thin plate that protrudes from the left wall 30 toward the left along the bottom wall 31. The upper end leg portion 307 is provided in the vicinity of a center portion of the left wall 30 and the length of the upper end leg portion 307 is approximately one third the length, in the front-rear direction, of the left wall 30. The lower end leg portion 308 extends from further to the front than the first intermediate leg portion 303 as far as the front end portion of the left wall 30. The height of protrusion of the upper end leg portion 307 and the lower end leg portion 308 from the outer surface of the left wall 30 is the same as the height of protrusion of the leg portions 301 to 303. Therefore, when the cartridge 11 is placed on the flat surface with the left wall 30 on the lower side, the cartridge 11 may be stably supported by the leg portions 301 to 303, the upper end leg portion 307 and the lower end leg portion 308, in a state in which the whole of the left wall 30 is separated from the flat surface. As a result, the user can insert his/her fingers into the gap from the front end portion of the left wall 30, from the rear end portion around the first rear end leg portion 301 and the second rear end leg portion 302, from sections of the upper end portion on which the upper end leg portion 307 is not provided and from a section of the lower end portion on which the lower end leg portion 308 is not provided. The user can thus easily pick up the cartridge 11.

When the cartridge 11 is placed on the flat surface with the left wall 30 on the upper side, in addition to the leg portions 301 to 303, the user can grip the upper end leg portion 307 and the lower end leg portion 308 with his/her fingers, or can hook his/her fingers around the upper end leg portion 307 and the lower end leg portion 308 and move the cartridge 11. Thus, the degree of freedom in handling the cartridge 11 may be improved. In particular, as the upper end leg portion 307 and the lower end leg portion 308 are thin plates, the user can easily hold one of them between fingers and pick up the cartridge 11. In this way, the user can easily pick up the cartridge 11 from a state in which it is placed on top of the flat surface. Additionally, when the cartridge 11 is mounted into the cartridge mounting portion 108 of the printer 100 as shown in FIG. 20, the lower end leg portion 308, which extends along the bottom wall 31 from further to the front than the first intermediate leg portion 303 as far as the front end portion of the left wall 30, contacts the placement surface 130. Therefore, the cartridge 11 may be guided inside the cartridge mounting portion 108 with an even more stable posture.

Figure 24:
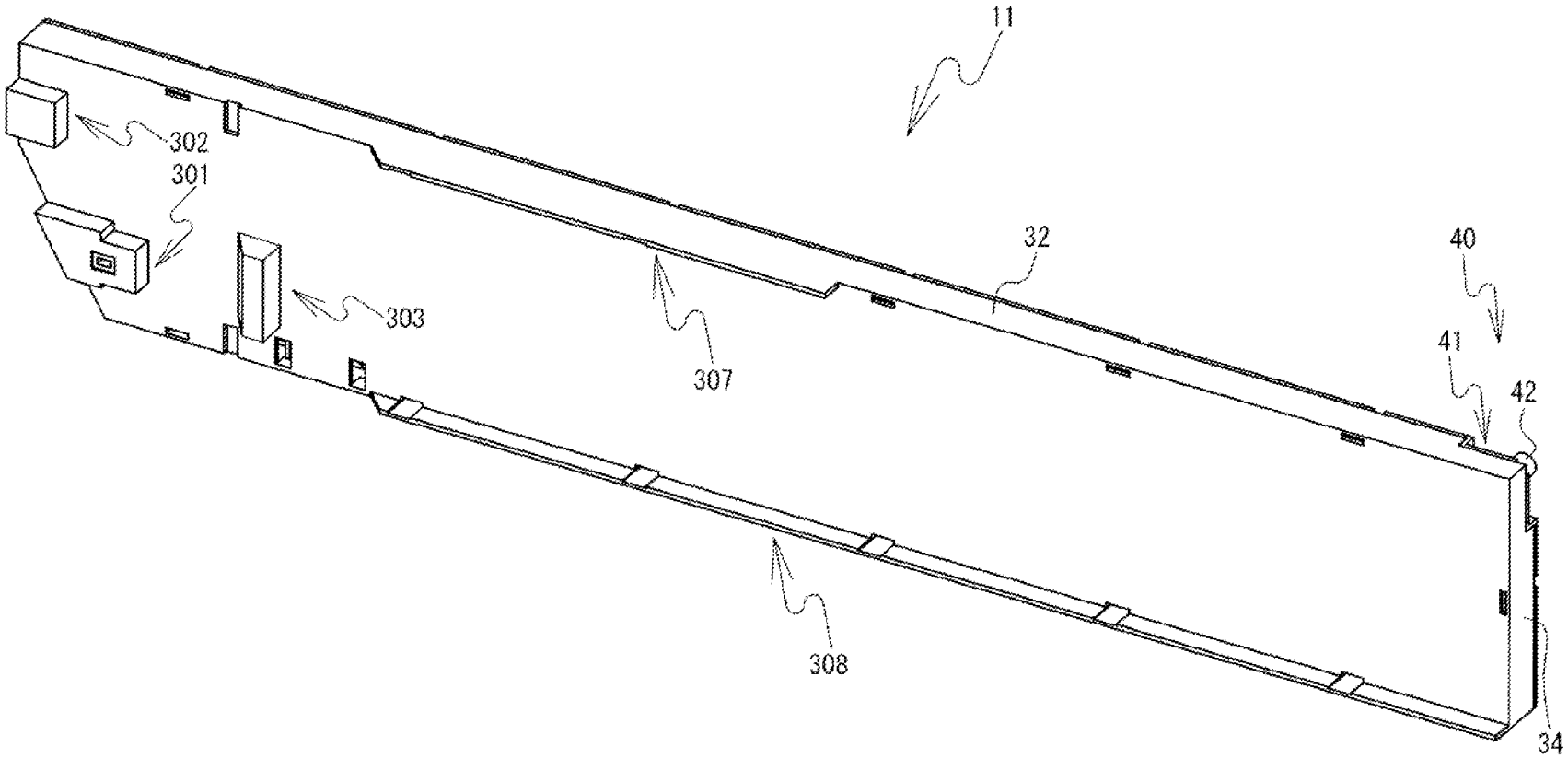
FIG. 24 is a perspective view of an ink cartridge 11 as viewed from the front left.

Note that the lengths, in the front-rear direction, of the upper end leg portion 307 and the lower end leg portion 308 of the cartridge 11 are not limited to the example shown in FIG. 24 and may be changed as appropriate. For example, the upper end leg portion 307 may extend as far as the front end portion of the left wall 30, and the lower end leg portion 308 may be shorter than the example shown in FIG. 24. Note also that, from the point of view of securing the gap into which the user can insert his/her fingers, it may be preferable that the upper end leg portion 307 and the lower end leg portion 308 do not have a length that covers the whole extent of the left wall 30. Further, similar leg portions may also be provided on the upper end portion and the lower end portion of the left wall 30 on the shorter ink cartridge 10 shown in FIG. 17.

In the above-described embodiment, the example is explained of the handle portion 40 (refer to FIG. 3) that is formed in the lid portion 4 in the upper right corner portion of the front end portion of the case 2. However, the handle portion 40 may be provided in any end portion of the case 2. Further, the handle portion 40 may be configured in any manner as far as the recessed portion 41 and the protruding portion 42 are provided, such that the recessed portion 41 is formed in any of the outer surfaces of the case 2 by indenting the case 2 from the outer surface to the inner side, such that the recessed portion 41 is open in at least two directions with respect to the outer surfaces of the case 2, and such that the protruding portion 42 protrudes from the bottom portion of the recessed portion 41. Hereinafter, handles 401 to 407 according to modified examples will be explained with reference to FIG. 25 to FIG. 30.

Figure 25:
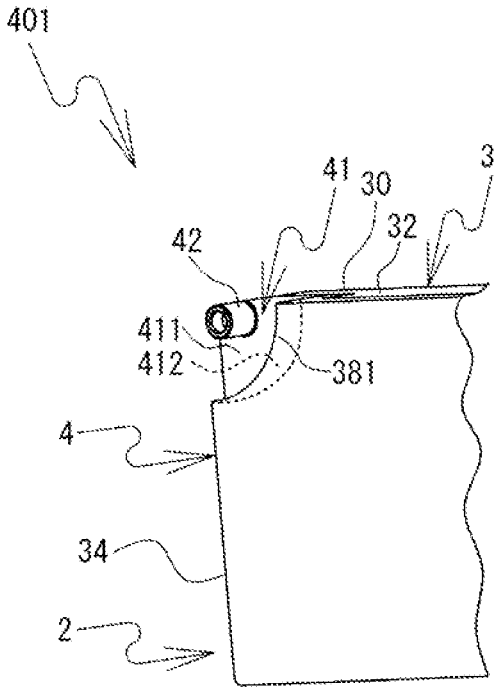
FIG. 25 is an explanatory diagram of a handle portion 401.

As shown in FIG. 25, similarly to the handle portion 40 (refer to FIG. 3) of the cartridge 1, the handle portion 401 is provided in the upper right corner portion on the front end portion of the case 2. However, the handle portion 401 is formed from a part of the body portion 3 and a part of the lid portion 4. Specifically, when seen from a direction that is orthogonal to the right side surface of the case 2, the upper left corner portion of the lid portion 4 is cut out in an arc shape, thus forming a cut-out portion 381. The corner portion of the left wall 30 that faces the corner portion of the lid portion 4 in which the cut-out portion 381 is formed, does not have a cut-out portion and this corner portion forms a right angle. A fan-shaped area of this corner portion that corresponds to the cut-out portion 381 is the bottom portion 411 of the recessed portion 41. The peripheral wall portion 412 extends along the arc-shaped outer edge of the cut-out portion 381, and protrudes from the inner surface of the lid portion 4 (the surface facing the left wall 30) as far as the bottom portion 411 of the left wall 30. Similarly to the protruding portion 42 shown in FIG. 3, the protruding portion 42 protrudes from the bottom portion 411 toward the right. The recessed portion 41 is open to the right, to the front and to the upper side of the case 2.

In the case 2 that is provided with the handle portion 401, at least the left wall 30 having the bottom portion 411 and the protruding portion 42 are integrally formed of plastic. Further, at least the lid portion 4 and the peripheral wall portion 412 are integrally formed of plastic.

With this type of the handle portion 401, similar operations and effects can be obtained as with the handle portion 40 described above and shown in FIG. 3. Specifically, even when a plurality of the cartridges having the handle portion 401 are arranged side by side with only slight gaps between them, the user can easily remove a selected cartridge from among the cartridges. As described above, the bottom portion 411 of the recessed portion 41 is a part of the left wall 30, and thus the depth of the recessed portion 41 of the handle portion 401 corresponds to the distance from the outer surface of the lid portion 4 to the inner surface of the left wall 30. In other words, the depth substantially corresponds to the width of the case 2 in the left-right direction. As a result, the recessed portion 41 of the handle portion 401 shown in FIG. 25 is deeper than the recessed portion 41 of the handle portion 40 shown in FIG. 3. Thus, a larger space is provided in the recessed portion 41 of the handle portion 401 for the user to insert his/her fingers, and it may be easier for the user to insert his/her fingers.

Figure 26:
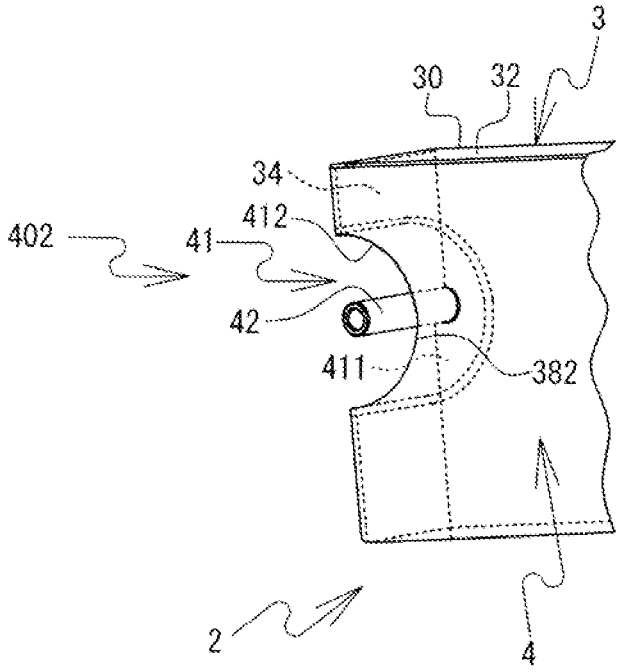
FIG. 26 is an explanatory diagram of a handle portion 402.

As shown in FIG. 26, the handle portion 402 is provided on the front end portion of the case 2. However, the handle portion 402 is not formed in a corner portion of the case 2, but is provided in the vicinity of a center portion of the front wall 34 in the up-down direction. The handle portion 402 is also formed from a part of the body portion 3 and a part of the lid portion 4. When seen from a direction that is orthogonal to the right side surface of the case 2, a semi-circle is cut out in the vicinity of the center portion, in the up-down direction, of the left end portion of the lid portion 4, thus forming a cut-out portion 382. No cut-out portion is formed in the end portion (the end portion on the front end side of the case 2) of the left wall 30 that faces the cut-out portion 382, and the end portion is formed in a straight line. An area of a semi-circle in this end portion that corresponds to the cut-out portion 382 is the bottom portion 411 of the recessed portion 41. The peripheral wall portion 412 extends along a section of the outer edge of the bottom portion 411 excluding the edge of the left wall 30, that is, along the semi-circle shaped edge of the bottom portion 411, and protrudes from the inner surface of the left wall 30 (the surface facing the lid portion 4) as far as the outer edge of the cut out portion 382. The peripheral wall portion 412 is a curved wall portion that is formed continuously with the front wall 34 such that the front wall 34 is indented in a U-shape toward the inner surface side of the case 2. The protruding portion 42 is provided in the vicinity of the center of the semi-circle of the bottom portion 411, and protrudes toward the right. The recessed portion 41 is open to the right and to the front of the case 2. In the case 2 that is provided with the handle portion 402, at least the left wall 30 having the bottom portion 411, the peripheral wall portion 412 and the protruding portion 42 are integrally formed of plastic.

With this type of the handle portion 402, the user can, for example, insert his/her index finger and thumb from the front side of the case 2 into the recessed portion 41, can hold the protruding portion 42 from above and below with his/her fingers and pull it toward the front. Thus, even when the plurality of the cartridges having the handle portion 402 are arranged side by side with only slight gaps in between them, the user can easily remove a desired cartridge from among the plurality of cartridges.

Figure 27:
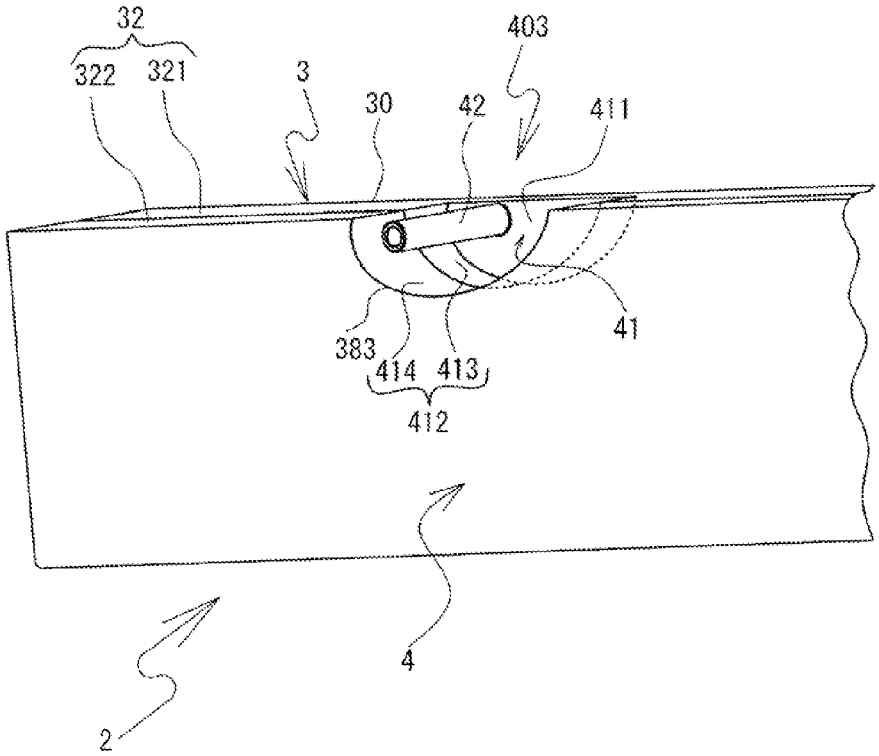
FIG. 27 is an explanatory diagram of a handle portion 403.

As shown in FIG. 27, in the case 2 that is provided with the handle portion 403, the top wall 32 is separated into the body portion 3 and the lid portion 4 along a central line in the left-right direction. Specifically, the top wall 32 is formed of a first top wall 321 that is continuous from the left wall 30 of the body portion 3, and a second top wall 322 that is continuous to the lid portion 4. The handle portion 403 is formed from a part of the body portion 3 and a part of the lid portion 4. When seen from a direction that is orthogonal to the right side surface of the case 2, a part of the upper end portion of the lid portion 4 is cut out in a semi-circle shape, thus forming a cut-out portion 383. No cut-out portion is formed on the end portion (the end portion on the upper end side of the case 2) of the left wall 30 that faces the cut-out portion 383 and the end portion is formed in a straight line. An area of a semi-circle in this end portion that corresponds to the cut-out portion 383 is the bottom portion 411 of the recessed portion 41.

From the inner surface of the left wall 30 (the surface facing the lid portion 4), a first peripheral wall 413, which has the same height of protrusion as the first top wall 321, extends along the semi-circle shaped edge of the bottom portion 411, and protrudes in the direction of the lid portion 4. Meanwhile, from the inner surface of the lid portion 4 (the surface facing the left wall 30), a second peripheral wall 414, which has the same height of protrusion as the second top wall 322, extends along the outer edge of the semi-circle shaped cut-out portion 383, and protrudes in the direction of the left wall 30. The peripheral wall portion 412 is formed of the first peripheral wall 413 and the second peripheral wall 414. The peripheral wall portion 412 is a curved wall portion that is formed continuously with the top wall 32 such that the top wall 32 is indented in a U-shape toward the inner surface side of the case 2. The protruding portion 42 is provided in the vicinity of the center of the semi-circle of the bottom portion 411, and protrudes toward the right. The recessed portion 41 is open to the right and to the upper side of the case 2. In the case 2 that is provided with the handle portion 403, at least the left wall 30 having the bottom portion 411, the first peripheral wall 413 and the protruding portion 42 are integrally formed of plastic. At least the lid portion 4 and the second peripheral wall 414 are integrally formed of plastic.

With this type of the handle portion 403, the user can insert his/her index finger from the upper end side of the case 2 in behind the protruding portion 42 of the recessed portion 41, for example, and can hook his/her finger around the protruding portion 42 and pull it toward the front. Further, the user can also grip the protruding portion 42 from the front and rear and pull it upward. Thus, even when a plurality of the cartridges having the handle portion 403 are arranged side by side without any gaps or with only slight gaps between them, the user can easily remove a desired cartridge from among the plurality of cartridges.

Figure 28:
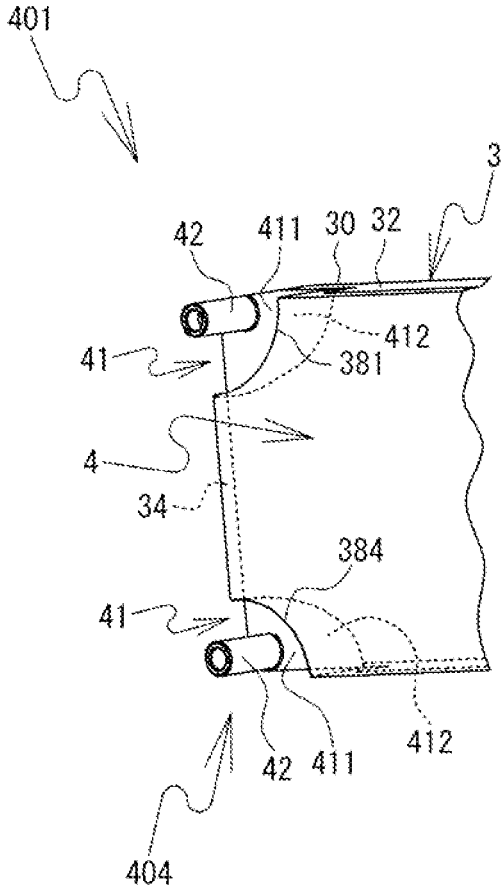
FIG. 28 is an explanatory diagram of the handle portion 401 and a handle portion 404.

FIG. 28 shows an example in which the handle portion 401 and the handle portion 404 are respectively provided on the upper right corner portion and the lower right corner portion on the front end portion of the case 2. The handle portion 401 is as explained with reference to FIG. 25. The structure of the handle portion 404 is basically the same as that of the handle portion 401, apart from having a vertically symmetrical shape of the handle portion 401. Specifically, when seen from a direction that is orthogonal to the right side surface of the case 2, the lower left corner portion of the lid portion 4 is cut out in an arc shape, thus forming a cut-out portion 384. The corner portion of the left wall 30 that faces the cut-out portion 384 is the bottom portion 411 of the recessed portion 41. The peripheral wall portion 412 extends along the outer edge of the cut-out portion 384, and is provided from the lid portion 4 as far as the bottom portion 411. The protruding portion 42 protrudes from the bottom portion 411 toward the right. The recessed portion 41 of the handle portion 404 is open to the right, to the front and to the lower side of the case 2. In the case 2 that is provided with the handle portion 401 and the handle portion 404, at least the left wall 30 having the two bottom portions 411 and the two protruding portions 42 are integrally formed of plastic. Further, at least the lid portion 4 and the two peripheral walls 412 are integrally formed of plastic.

With this type of the handle portion 401 and the handle portion 404, in addition to the same effects being obtained by the handle portion 401 as those of the handle portion 40 shown in FIG. 3, the cartridge can be removed from another direction using the handle portion 404. For example, even when a plurality of the cartridges having the handles 401 and 404 are arranged side by side, with the top wall 32 on the lower side, without any gaps or with only slight gaps between them, the user can easily remove the desired cartridge from among the plurality of cartridges using the handle portion 404.

Figure 29:
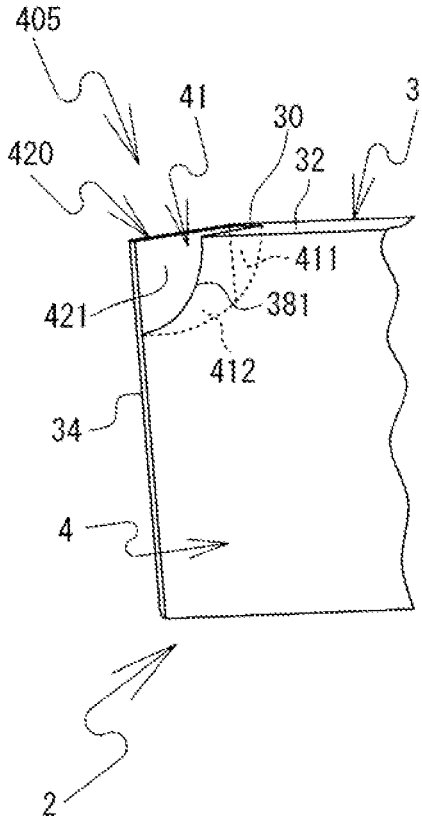
FIG. 29 is an explanatory diagram of a handle portion 405.

In the handle portion 405 shown in FIG. 29, the cylinder-shaped protruding portion 42 of the handle portion 401 shown in FIG. 25 is replaced by a flat plate-shaped protruding portion 420. The protruding portion 420 protrudes from the bottom portion 411 of the recessed portion 41 toward the lid portion 4. In the present embodiment, the protruding portion 420 is provided continuously upward from the front wall 34. The side of the protruding portion 420 that faces toward the inside of the case 2, specifically, the back surface side of the protruding portion 420, is a surface portion 421. In the handle portion 405, the recessed portion 41 is open to the right and to the upper side of the case 2. In the case 2 that is provided with the handle portion 405, at least the left wall 30 having the bottom portion 411 and the protruding portion 420 are integrally formed of plastic. Further, at least the lid portion 4 and the peripheral wall portion 412 are integrally formed of plastic.

When the cartridge that is provided with this type of the handle portion 405 is mounted into the printer 100 (refer to FIG. 1), the protruding portion 420 extends in the up-down direction of the printer 100 and the surface portion 421 is disposed such that it faces the rear inner side of the printer 100. Thus, when removing the cartridge from the printer 100, for example, the user can insert his/her index finger into the recessed portion 41 from the right side of the case 2, can place his/her index finger on the surface portion 421 that is on the rear inner side of the protruding portion 420 and his/her thumb on the front side of the protruding portion 420, and can grip the protruding portion 420 from the front and the rear. Thus, even when a plurality of the cartridges provided with the handle portion 405 are mounted in the printer 100, the user can easily pull out and remove the desired cartridge from the printer 100.

Figure 30:
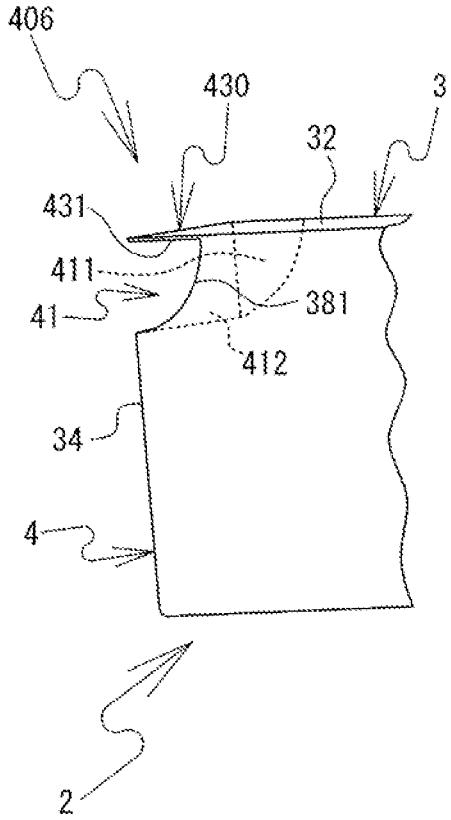
FIG. 30 is an explanatory diagram of a handle portion 406.

In the handle portion 406 shown in FIG. 30, a protruding portion 430 that is continuous from the top wall 32 is provided in place of the protruding portion 420 of the handle portion 405 shown in FIG. 29, and the peripheral wall portion 412 is a wall portion that protrudes not from the lid portion 4, but from the left wall 30. The protruding portion 430, while protruding to the right from the bottom portion 411 of the recessed portion 41, also extends in the front-rear direction of the case 2, similarly to the top wall 32. The side of the protruding portion 430 that faces toward the inside of the case 2, specifically, the lower side of the protruding portion 430, is a surface portion 431. In the handle portion 406, the recessed portion 41 is open to the right and to the front of the case 2. In the case 2 that is provided with the handle portion 406, at least the left wall 30 having the bottom portion 411, the peripheral wall portion 412 and the protruding portion 430 are integrally formed of plastic.

When the cartridge that is provided with this type of the handle portion 406 is mounted into the printer 100 (refer to FIG. 1), the protruding portion 430 extends in the front-rear direction (from the front toward the rear inner side) of the printer 100 and the surface portion 431 is disposed such that it faces the lower side of the printer 100. Thus, when removing the cartridge from the printer 100, for example, the user can insert his/her index finger into the recessed portion 41 from the front side of the case 2, can place his/her index finger on the surface portion 431 that is on the lower side of the protruding portion 430 and his/her thumb on the upper side of the protruding portion 430, and can grip the protruding portion 430 from above and below. Thus, even when a plurality of the cartridges provided with the handle portion 406 are mounted in the printer 100, the user can easily pull out and remove the desired cartridge from the printer 100.

The modifications of the handle portion 40 (refer to FIG. 3) are not limited to the examples shown in FIG. 25 to FIG. 30, and other modifications may be made as appropriate. For example, the peripheral wall portion 412 of the recessed portion 41 need not necessarily be the wall portion that has the curved surface. For example, in place of the arc-shaped cut-out portion 381 shown in FIG. 25, a reverse L-shaped cut-out portion may be formed in the corner portion of the lid portion 4, and a peripheral wall may be formed by providing two flat plate-shaped wall portions that extend along the L-shaped cut-out portion. Further, the shape of the protruding portion 42 is not limited to a hollow cylinder shape, and can be changed to, for example, a filled-in cylinder shape, a cylinder shape with a constricted section, an elliptic cylinder shape, a prism shape with corners, or a ring that has a hole into which a finger can be inserted, and so on. The handle portion 40, in particular, the protruding portion 42, may be prepared as a member that is different from the case 2, and then attached to the case 2.

As described above, the first intermediate leg portion 303 and the second intermediate leg portion 304 of the cartridge 1, 10, 11 (refer to FIG. 2, FIG. 17 and FIG. 24) are the color indicator portion that is configured to indicate the ink color. The user can view this portion in order to determine whether the ink stored inside the case 2 is white or other than white.

Further, with the printer 100 shown in FIG. 1, the ink color corresponding to each of the cartridge mounting portions 108 is set as one of white and other than white. A function may be added to the printer 100 to inhibit mounting of the cartridge 1, 10, 11 with the wrong color into the cartridge mounting portion 108. A printer 140 of this type of modified example will be explained with reference to FIG. 31 and FIG. 32. An up-down direction, a left-right direction and a paper surface front side in FIG. 32 respectively correspond to an up-down direction, a left-right direction and a front side of the printer 140.

Figure 31:
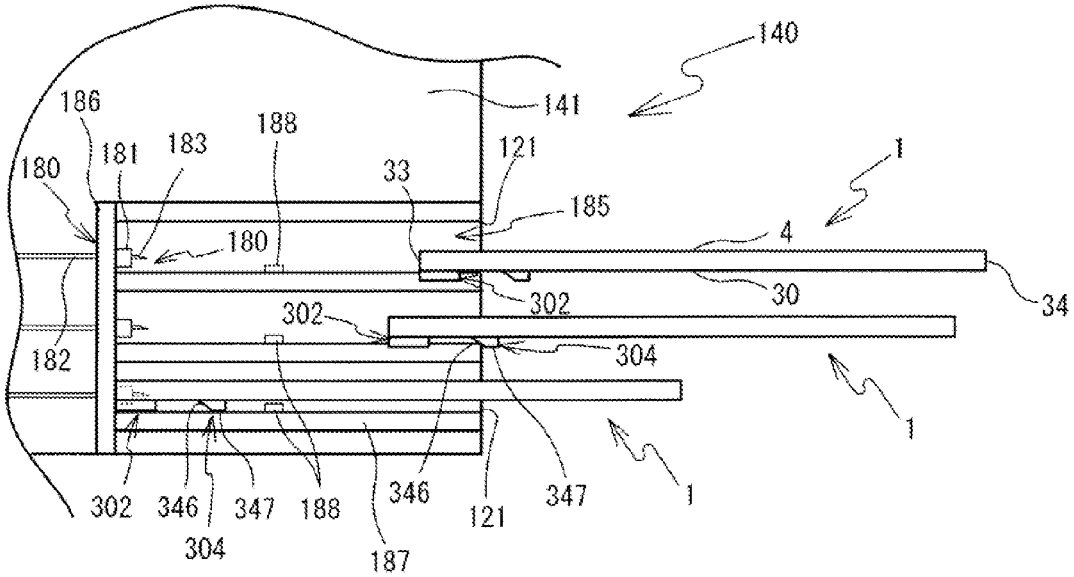
FIG. 31 is an explanatory diagram of a process in which the ink cartridges 1 are mounted in cartridge mounting portions 185 of a printer 140.
Figure 32:
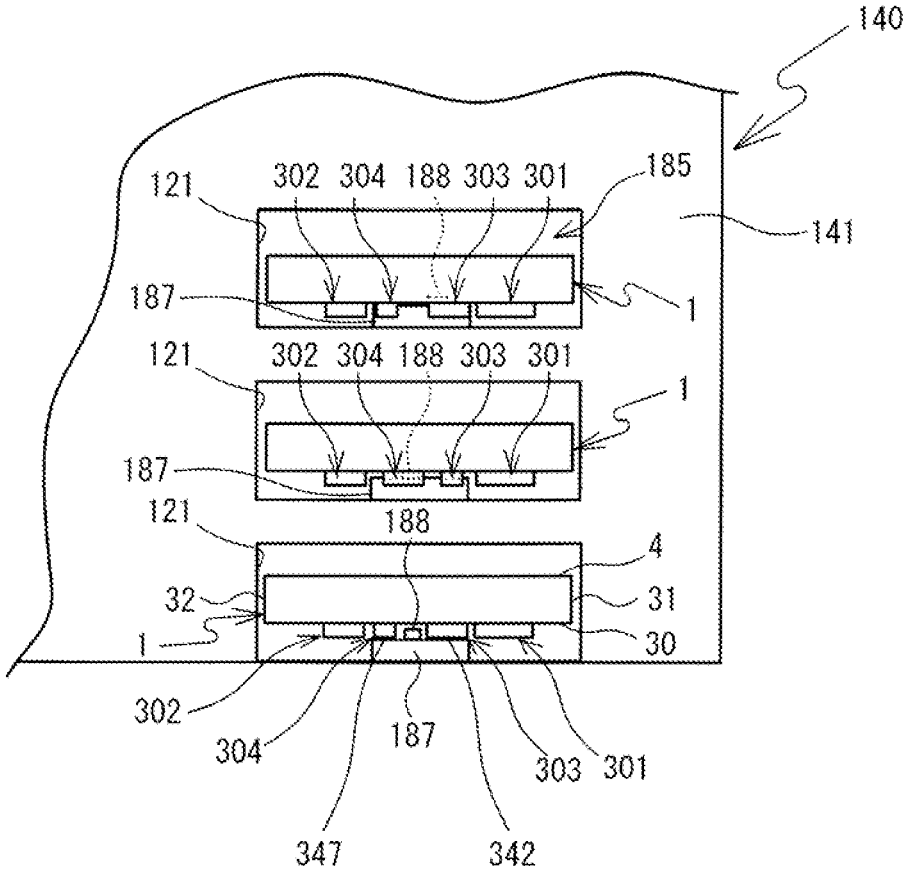
FIG. 32 is an explanatory diagram of the printer 140 and the ink cartridges 1 shown in FIG. 31, as viewed from the front.

The printer 100 shown in FIG. 1 is a type of printer in which the cartridge 1 is mounted with the bottom wall 31 on the lower side. The printer 140 shown in FIG. 31 and FIG. 32 is a type of printer in which the cartridge 1 is mounted with the left wall 30 on the lower side. As will be explained in more detail later, the printer 140 is also provided with a structure by which the cartridge 1 can be smoothly mounted, using the inclined surface portions 341 and 346 (refer to FIG. 2) of the first intermediate leg portion 303 and the second intermediate leg portion 304. Apart from this, the structure to perform printing (the print head 114 etc. shown in FIG. 1) and the structure to supply the ink (the connection portion 180 etc. shown in FIG. 19) are basically the same as those of the printer 100 and an explanation is therefore omitted or simplified below.

As shown in FIG. 31 and FIG. 32, the printer 140 includes a plurality of cartridge mounting portions 185 inside a housing 141. Note that, in order to simplify the explanation, only three of the cartridge mounting portions 185 are depicted, but in actuality, similarly to the printer 100 shown in FIG. 1, the printer 140 also has eight of the cartridge mounting portions 185. In addition, the front end leg portion 305 of the cartridge 1 is not depicted for the same reason. The cartridge 1 may be inserted into the cartridge mounting portion 185 from a cartridge insertion port 121.

The cartridge mounting portion 185 is a passage that is configured to guide the cartridge 1 inside the printer 140 such that the cartridge 1 is disposed in a state in which the ink can be supplied therefrom. The length of the cartridge mounting portion 185 in the front-rear direction is approximately two thirds of the length of the cartridge 1 in the front-rear direction. Thus, the shorter cartridge 10 shown in FIG. 17 is not used in the printer 140. The length of the cartridge mounting portion 185 in the up-down direction is approximately twice the length, in the left-right direction, of the cartridge 1 that includes the leg portions 301 to 304. The length of the cartridge mounting portion 185 in the left-right direction is slightly longer than the length of the cartridge 1 in the up-down direction (the distance from the outer surface of the top wall 32 to the outer surface of the bottom wall 31).

As shown in FIG. 31, a contact plate 186 is provided on the end portion on the rear inner side (the left side in FIG. 31) of the cartridge mounting portion 185. The rear wall 33 (more specifically, the back surface portion 331) of the cartridge 1 guided inside the cartridge mounting portion 185 may come into contact with the contact plate 186. The fixing portion 181 that has the suction needle 183 is fixed to the contact plate 186. In the printer 140 also, the ink color corresponding to each of the cartridge mounting portions 185, namely, the color of the ink that should be drawn out by each of the suction needles 183, is set as one of white and other than white.

A placement portion 187 is provided inside the cartridge mounting portion 185. The placement portion 187 is a long parallelepiped shaped member that extends from the cartridge insertion port 121 to the contact plate 186. As shown in FIG. 32, the length of the placement portion 187 in the left-right direction is approximately one third the length of the cartridge mounting portion 185 in the left-right direction. This length is slightly shorter than the distance between the opposing side faces of the first rear end leg portion 301 and the second rear end leg portion 302. The placement portion 187 is fixed to a center portion, in the left-right direction, of the bottom surface of the cartridge mounting portion 185. The placement portion 187 is a portion that is configured to guide the cartridge 1 inside the cartridge mounting portion 185 to a correct position in the up-down direction of the printer 140, using the first intermediate leg portion 303 and the second intermediate leg portion 304.

As shown in FIG. 31, a color identification protrusion 188 is provided slightly to the rear (to the left in FIG. 31) of the center of the placement portion 187 in the front-rear direction. The color identification protrusion 188 protrudes from the upper surface of the placement portion 187. As shown in FIG. 32, a position of the color identification protrusion 188 differs in the left-right direction, in accordance with the ink color (white or other than white) that is set for each of the cartridge mounting portions 185. More specifically, in a case of the cartridge mounting portion 185 for the white ink, as with the cartridge mounting portions 185 shown in the center and on the lowermost side, the color identification protrusion 188 is disposed slightly to the left side from the center of the placement portion 187 in the left-right direction. This position corresponds to the determination area R (refer to FIG. 6) of the cartridge 1 that is inserted into the cartridge mounting portion 185 with the left wall 30 on the lower side. On the other hand, in a case of the cartridge mounting portion 185 for the ink that is other than white, as with the cartridge mounting portion 185 shown on the uppermost side, the color identification protrusion 188 is disposed slightly to the right side from the center of the placement portion 187 in the left-right direction. This position corresponds to a section other than the determination area R (refer to FIG. 6) of the cartridge 1 that is inserted into the cartridge mounting portion 185 with the left wall 30 on the lower side, and in the cartridge 1 for the ink color that is other than white, the first intermediate leg portion 303 and the second intermediate leg portion 304 are not disposed in this position. The color identification protrusion 188 is thus the portion that is configured to inhibit the cartridge 1 with the wrong color from being mounted into the cartridge mounting portion 185.

The operations and effects of the placement portion 187 and the color identification protrusion 188, when the cartridge 1 is mounted into the cartridge mounting portion 185, will be explained. First, as shown in the cartridge mounting portion 185 on the uppermost side in FIG. 31 and FIG. 32, the cartridge 1 is inserted from the cartridge insertion port 121. At this time, the placement portion 187 is positioned between the first rear end leg portion 301 and the second rear end leg portion 302, and normally, the outer surface (the surface on the lower side in the drawings) of the left wall 30 is placed on the upper surface of the placement portion 187. If the user pushes in the cartridge 1 in this state, the placement portion 187 is sandwiched between the first rear end leg portion 301 and the second rear end leg portion 302 from the right and the left, and the cartridge 1 is guided toward the rear inner side while the outer surface of the left wall 30 slides over the upper surface of the placement portion 187.

If the cartridge 1 advances in this manner, the first intermediate leg portion 303 and the second intermediate leg portion 304 bump up against the front surface of the placement portion 187. However, the gradually sloping inclined surface portions 341 and 346 (refer to FIG. 2) are provided on the first intermediate leg portion 303 and the second intermediate leg portion 304, such that the protrusion height of the first intermediate leg portion 303 and the second intermediate leg portion 304 becomes larger from the rear inner side toward the front side of the printer 140. As a result, as shown in the cartridge mounting portion 185 in the center in FIG. 31 and FIG. 32, the cartridge is gradually carried upward by the inclined surface portions 341 and 346. If the cartridge 1 is further pushed toward the rear inner side, the cartridge 1 enters a state in which the flat surface portions 342 and 347 that are on the front (the right side in FIG. 31) of the inclined surface portion 341 and 346 rest on the upper surface of the placement portion 187, and positioning of the cartridge 1 in the cartridge mounting portion 185 in the up-down direction of the printer 140 has been completed.

If the cartridge 1 is further pushed toward the rear inner side, the cartridge 1 is guided toward the rear inner side while the flat surfaces 342 and 347 slide over the upper surface of the placement portion 187. When the first intermediate leg portion 303 and the second intermediate leg portion 304 reach the position of the color identification protrusion 188, if the color identification protrusion 188 is between the first intermediate leg portion 303 and the second intermediate leg portion 304, as shown in the cartridge mounting portion 185 on the lowermost side in FIG. 32, the cartridge 1 can slide further to the rear inner side. Consequently, as shown in the cartridge mounting portion 185 on the lowermost side in FIG. 31, the rear end portion of the cartridge 1 reaches the connection portion 180, the suction needle 183 pierces the rubber plug 723 (refer to FIG. 14) of the ink bag 71 via the spout opening 335 and the cartridge 1 enters a state in which the ink can be supplied. Note that, as described above, when the cartridge 1 is positioned in the up-down direction of the printer 140 by the placement portion 187, the connection portion 180 is disposed in a position such that the suction needle 183 faces the spout opening 335.

On the other hand, as shown in the cartridge mounting portions 185 on the uppermost side and in the center in FIG. 32, when there is interference between the color identification protrusion 188 and the first intermediate leg portion 303 or the second intermediate leg portion 304, the cartridge 1 cannot move further toward the rear inner side. Consequently, the rear end portion of the cartridge 1 cannot reach the connection portion 180. In this way, the color identification protrusion 188 can reliably inhibit the suction needle 183 of the connection portion 180 from connecting to the spout 72 of the cartridge 1 that stores the ink having a different color to that of the ink that is set corresponding to the cartridge mounting portion 185.

In this way, in the printer 140, the first intermediate leg portion 303 and the second intermediate leg portion 304 gradually move up on the placement portion 187 by their inclined surface portions 341 and 346, and thus the first intermediate leg portion 303 and the second intermediate leg portion 304 may function to help the cartridge 1 to be smoothly mounted in the correct position in the up-down direction in the cartridge mounting portion 185. Further, in concert with the color identification protrusion 188, the first intermediate leg portion 303 and the second intermediate leg portion 304 may also function to inhibit the cartridge 1 with the wrong color from being completely mounted into the cartridge mounting portion 185. Note that, in the above-described example, both the first intermediate leg portion 303 and the second intermediate leg portion 304 are provided on the cartridge 1. However, as described above, the leg portion functioning as the color indicator portion may be disposed in accordance with the ink color, in relation to the determination area R, and both the first intermediate leg portion 303 and the second intermediate leg portion 304 need not necessarily be provided.

The color identification protrusion 188 may also be provided in the printer 100 shown in FIG. 1 and FIG. 20. In that case, for example, the color identification protrusion 188 may be provided such that it protrudes to the right from a side surface that defines the left inner surface of the cartridge mounting portion 108. The position of the color identification protrusion 188 in the up-down direction of the cartridge mounting portion 108 may be a position that faces the determination area R (refer to FIG. 6) when the cartridge 1 is mounted in the cartridge mounting portion 108. Further, a position of the color identification protrusion 188 in the front-rear direction may need to be further to the front (to the cartridge insertion port 121 side) than the positions in which the first intermediate leg portion 303 and the second intermediate leg portion 304 are disposed when the cartridge 1 is completely mounted in the cartridge mounting portion 108. In this way, in the primer 100 also, by the first intermediate leg portion 303 and the second intermediate leg portion 304 of the cartridge 1 working in concert with the color identification protrusion 188, it is possible to inhibit the cartridge 1 of the wrong color from being completely mounted in the cartridge mounting portion 108.

Figure 33:
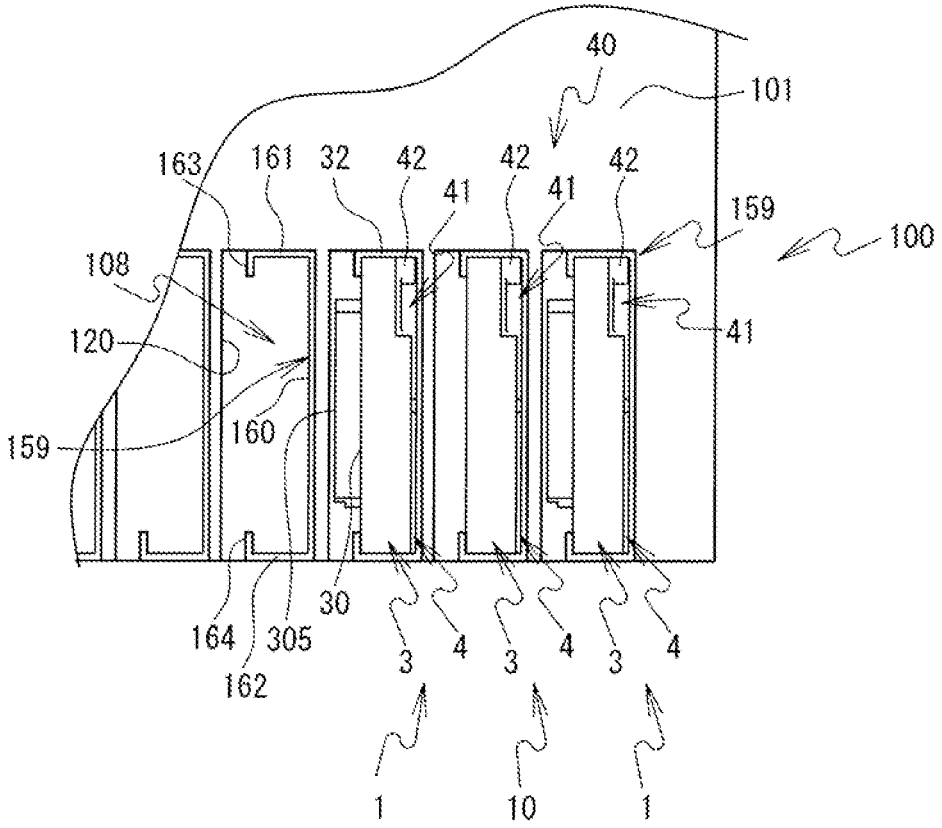
FIG. 33 is an explanatory diagram of the printer 100 that is provided with holders 159.

Further, the cartridge mounting portions 108 and 185 of the printers 100 and 140 shown, respectively, in FIG. 1 and FIG. 31 are both formed as the passages inside the housings 101 and 141. However, the structure that allows the cartridge 1 etc. to be mounted in the printer is not limited to these examples. For example, as shown in FIG. 33, a holder 159 that is configured to hold the cartridge 1 etc. may be provided inside the cartridge mounting portion 108 of the printer 100. Note that, when the holder 159 is provided, the cartridge mounting portion 108 may be omitted.

The holder 159 includes a plate-shaped side surface portion 160 that extends along the inside surface on the right side of the cartridge mounting portion 108 in the front-rear direction, and rail portions 161 and 162 that extend to the left from the upper end and the lower end of the side surface portion 160, respectively. The left end portion of the upper rail portion 161 is a bent portion 163 that is bent downward, and the left end portion of the lower rail portion 162 is a bent portion 164 that is bent upward. The length of the rail portions 161 and 162 from the side surface portion 160 to the bent portions 163 and 164 is slightly longer than the distance from the left side surface of the body portion 3 to the right side surface of the lid portion 4. Thus, when the cartridge 1 is inserted from the cartridge insertion port 120, the cartridge 1 may be held in a state in which the upper end portion and the lower end portion of the cartridge 1 are sandwiched by the side surface portion 160 and the bent portions 163 and 164 of the rail portions 161 and 162, respectively. Thus, the cartridge 1 can be guided with a stable posture toward the rear inner side of the cartridge mounting portion 108.

In the cartridge 1 etc. to be mounted in the printer 100 that is provided with this type of the holder 159, the leg portions (the leg portions 301 to 305 shown in FIG. 2, the upper end leg portion 307 and the lower end leg portion 308 shown in FIG. 24 and so on) that protrude from the outer surface of the left wall 30 may need to be disposed in sections other than those that are to be held by the holder 159. More specifically, all of the leg portions may need to be disposed in positions, in the up-down direction of the left wall 30, that do not face the bent portions 163 and 164, such that there is no interference between the leg portions and the bent portions 163 and 164. Accordingly, the leg portions are not provided in the positions such as the upper end leg portion 307 and the lower end leg portion 308 shown in FIG. 24.

The case 2 of the above-described embodiment is an example in which the case 2 includes the lid portion 4 and the left wall 30 that are the pair of wall portions facing each other, and the peripheral walls 31 to 34 that are continuous to the left wall 30. Namely, roughly the whole of the case 2 is covered by the wall portions. However, some of the wall portions that form the case 2 may be omitted. The front wall 34 may be omitted, for example. The bottom wall 31 and the top wall 32 need not necessarily cover the whole of the case 2 in the longitudinal direction, and part of the bottom wall 31 and the top wall 32 may have openings. Further, it is not necessary to provide all of the peripheral walls 31 to 34 on the body portion 3, and some or all of the peripheral walls 31 to 34 may be provided on the lid portion 4.

In the above-described embodiment, as shown in FIG. 2, the first rear end leg portion 301 is disposed in the position that corresponds to the spout opening 335, and may function as the housing space and the fixing portion of the spout 72 (refer to FIG. 12). Further, the second rear end leg portion 302 is disposed in the position that corresponds to the first exposure opening 336, and may function as the movement-enabling space for the exposed portion 53 of the movable member 50 (refer to FIG. 16). However, the first rear end leg portion 301 and the second rear end leg portion 302 need not necessarily have these types of functions, and may be provided without relation to these openings and internally disposed members. The spout 72 may be disposed in another position inside the case 2. The movable member 50 need not necessarily be the remaining ink amount indicator member. The movable member 50 need not necessarily be provided inside the case 2. In such a case, the first exposure opening 336 need not necessarily be provided in the inclined surface portion 331.

In the above-described embodiment, both the spout opening 335 and the first exposure opening 336 are formed as the recessed portions in the rear wall 33 that extend toward the left wall 30 from the end portion on the side that connects to the lid portion 4 when the body portion 3 and the lid portion 4 are joined together. However, these openings may be provided as holes formed in the inclined surface portion 332 and the back surface portion 331, respectively. In addition, the spout opening 335 may be formed in a similar shape to the first exposure opening 336. In other words, the connecting wall portion 337 need not necessarily be provided. In contrast, the first exposure opening 336 may be the recessed portion that does not extend as far as the bottom wall of the recessed portion that forms the second rear end leg portion 302 and the connecting wall portion may be provided.

In the above-described embodiment, the ranges in which the first intermediate leg portion 303 and the second intermediate leg portion 304, which may function as the color indicator portion, are provided is determined in relation to the determination area R shown in FIG. 6. The position of the determination area R is not limited to the example shown in FIG. 6, and may be in another position. However, it may be preferable that the determination area R be in a position that can be easily discerned by a user, in order for the user to determine the ink color by viewing the first intermediate leg portion 303 and the second intermediate leg portion 304. Thus, as in the above-described embodiment, it may be preferable for the determination area R to be set in reference to an easily understood marker. Note that, the first intermediate leg portion 303 and the second intermediate leg portion 304 need not necessarily function as the color indicator portion, and may simply function as the leg portions to support the cartridge 1.

In the above-described embodiment, the leg portions 301 to 305 (refer to FIG. 2) are integrally formed as the recessed portions in the left wall 30, but the leg portions 301 to 305 may be separate members that are connected to the left wall 30 by bonding or any another method.

The handle portion 40 (refer to FIG. 2) that is provided on the case 2 may be omitted.

Figure 34:
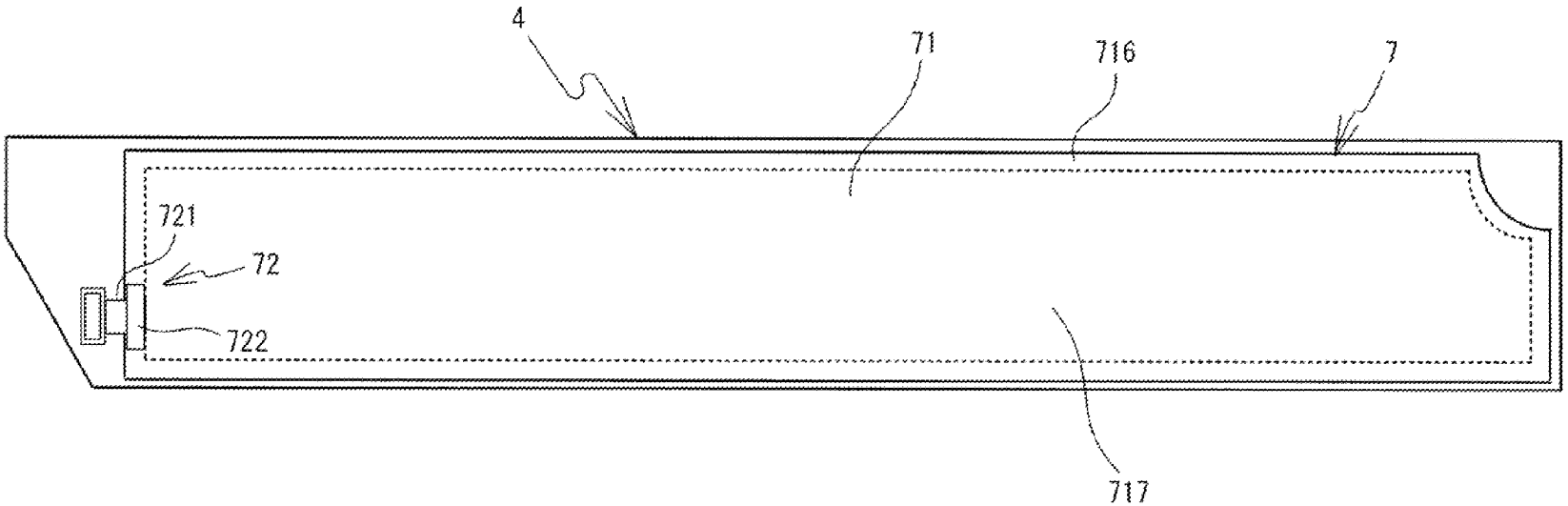
FIG. 34 is an explanatory diagram of the lid portion 4 to which an ink pack 7 is fixed.

In the above-described embodiment, the ink pack 7 is fixed to the left wall 30 of the body portion 3, but the ink pack 7 may be fixed by bonding the sheet surface of the ink bag 71 to the inner surface (the surface facing the left wall 30) of the lid portion 4, as shown in FIG. 34. Furthermore, a fixing portion that is configured to fix the spout 72 may be provided on the lid portion 4. In such a case, at the time of assembly of the case 2, by verifying the ink color of the ink pack 7 that is fixed to the lid portion 4, and verifying the positions of the first intermediate leg portion 303 and the second intermediate leg portion 304 provided on the body portion 3, an operator can assemble the lid portion 4, to which the ink pack 7 is fixed, and the body portion 3 without any mistake.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An ink cartridge comprising:

a substantially box-shaped case and that includes at least a first wall portion and a second wall portion that are a pair of plate-shaped wall portions arranged to oppose each other;

a bag-shaped ink bag that stores ink inside and that includes a spout through which the ink can be drawn out, the ink bag being housed in the case such that the spout is disposed in the vicinity of a first end of the first wall portion and an axial line of the spout extends substantially in parallel to a longitudinal direction of the first wall portion, the first end being one of ends positioned in the longitudinal direction of the first wall portion;

a first protruding portion that protrudes from an outer surface of the first wall portion and protrudes away from the second wall portion in a first direction, the first direction being a direction in which the first wall portion and second wall portion are opposed to each other, the first protruding portion being disposed along the first end of the first wall portion, and being separated from both ends positioned in a second direction of the first wall portion, the second direction being orthogonal to the longitudinal direction of the first wall portion; and a second protruding portion that protrudes from the outer surface of the first wall portion and protrudes away from the second wall portion in the first direction, the second protruding portion being disposed along the first end of the first wall portion, being separated from the first protruding portion, and also being separated from the both ends positioned in the second direction, wherein at least the first protruding portion is formed by indenting an area of the first wall portion along the first end away from the second wall portion in the first direction, the spout is fixed to the first protruding portion and housed in a housing space that is formed by the first protruding portion, and a maximum dimension of the spout in the first direction is larger than a distance between a largest area portion of the first wall portion and a largest area portion of the second wall portion in the first direction.

2. The ink cartridge according to claim 1, further comprising:

at least one third protruding portion that protrudes from the outer surface of the first wall portion and away from the second wall portion in the first direction and that is disposed in a section other than the first end of the first wall portion;

wherein the at least one third protruding portion is disposed in a position that is separated from the first protruding portion and the second protruding portion and is also within a range, in the second direction, in which the first protruding portion and the second protruding portion are disposed.

3. The ink cartridge according to claim 1, wherein the second protruding portion is a wall portion that forms an opening that exposes a component disposed inside the case such that the component is visible.

4. The ink cartridge according to claim 1, wherein the second protruding portion is a wall portion that forms a space in which a movable component disposed inside the case can move.

5. The ink cartridge according to claim 4, wherein the movable component is a remaining ink amount indicator member that moves in accordance with an amount of the ink stored in the ink bag.

6. The ink cartridge according to claim 2, wherein the at least one third protruding portion is a color indicator portion that indicates a color of the ink, and is disposed on the first wall portion in a range that is determined in accordance with the color of the ink stored in the ink bag.

7. The ink cartridge according to claim 1, wherein the second wall portion has an opening that exposes a part of the ink bag housed inside the case such that the part of the ink bag is visible.

8. The ink cartridge according to claim 1, wherein the second wall portion has an opening, that exposes a part of a component that is disposed inside the case such that the part of the component is visible.

9. The ink cartridge according to claim 1, wherein the ink bag is fixed to the first wall portion.

10. The ink cartridge according to claim 1, wherein the first end includes a straight line portion that extends in a direction that is substantially orthogonal to the longitudinal direction of the first wall portion, and an inclined portion that forms an obtuse angle with the straight line portion and that extends in a direction that obliquely intersects with the longitudinal direction of the first wall portion, the first protruding portion is disposed on the inclined portion, and the second protruding portion is disposed on the straight line portion.

11. The ink, cartridge according to claim 10, further comprising:

a fourth protruding, portion that protrudes from the outer surface of the first wall portion and away from the second wall portion in the first direction, the fourth protruding portion being disposed in the vicinity of a second end of the first wall portion that is on the opposite side to the first end in the longitudinal direction of the first will portion;

wherein an end of the second wall portion that faces the first end of the first wall portion has substantially a same shape as the first end, and the spout is fixed in the vicinity of the inclined portion of the first wall portion.

* * * * *